US012459702B2

(12) United States Patent
Forchione

(10) Patent No.: US 12,459,702 B2
(45) Date of Patent: Nov. 4, 2025

(54) ORGANIZATIONAL KIT AND METHOD OF USE

(71) Applicant: Unclutr, LLC, Macedonia, OH (US)

(72) Inventor: Andrew Forchione, Macedonia, OH (US)

(73) Assignee: Unclutr, LLC, Macedonia, OH (US)

( * ) Notice: Subject to any disclaimer, the term of this patent is extended or adjusted under 35 U.S.C. 154(b) by 0 days.

(21) Appl. No.: 18/450,869

(22) Filed: Aug. 16, 2023

(65) Prior Publication Data

US 2025/0058934 A1 Feb. 20, 2025

(51) Int. Cl.

*B65D 21/02* (2006.01)
*B65D 25/02* (2006.01)
*B65D 25/20* (2006.01)

(52) U.S. Cl.

CPC ..... *B65D 21/0201* (2013.01); *B65D 25/02* (2013.01); *B65D 25/20* (2013.01)

(58) Field of Classification Search

CPC ..... B65D 21/0201; B65D 25/02; B65D 25/20
USPC ..... 220/23.4
See application file for complete search history.

(56) References Cited

U.S. PATENT DOCUMENTS

| | | | | |
|---|---|---|---|---|
| D9,254 | S | 5/1876 | Cooper | |
| D43,499 | S | 2/1913 | Force | |
| 2,280,631 | A | 4/1942 | Coffey | |
| D164,219 | S | 8/1951 | Caldwell | |
| 3,027,041 | A | 3/1962 | Stansbury, Jr. et al. | |
| 3,418,668 | A | 12/1968 | Anderson | |
| D239,245 | S | 3/1976 | Fletcher et al. | |
| 4,099,611 | A | 7/1978 | Feibelman | |
| 4,718,554 | A | 1/1988 | Barbato | |
| 4,838,239 | A | 6/1989 | Ordeman | |
| 5,108,222 | A | 4/1992 | Jansson et al. | |
| D394,925 | S | 6/1998 | Robinson | |
| 6,719,141 | B2 * | 4/2004 | Heinz | B01L 9/06 206/443 |
| 6,769,538 | B2 * | 8/2004 | Oswald | A47K 5/00 220/571 |
| D537,729 | S | 3/2007 | Owaku | |
| 7,246,704 | B2 | 7/2007 | Brunson et al. | |
| 7,992,714 | B1 | 8/2011 | Devault et al. | |
| 8,439,200 | B1 | 5/2013 | Sorrells et al. | |
| 8,690,133 | B1 | 4/2014 | Hauser | |

(Continued)

*Primary Examiner* — Andrew D Perreault

(74) *Attorney, Agent, or Firm* — Sand, Sebolt & Wernow Co., LPA

(57) ABSTRACT

An organizational kit that includes a self-supporting structure and a plurality of storage apparatuses selectively interlockably engageable with the self-supporting at a plurality of interlocking openings defined in the self-supporting structure. Each storage apparatus includes a main body configured to store at least one object at least one connecting member that extends outwardly from the main body. The at least one connecting member also includes a first end that operably engages with the main body, a second end that is longitudinally opposite to the first end and spaced apart from the main body, and a shoulder that is positioned between the first end and the second end. The shoulder is configured to interlockably engage with the self-supporting structure inside of an interlocking opening wherein the self-supporting structure flexes around and conforms to the shoulder of at least one shoulder of each storage apparatus.

20 Claims, 17 Drawing Sheets

(56) References Cited

U.S. PATENT DOCUMENTS

| | | | | |
|---|---|---|---|---|
| D751,784 | S | 3/2016 | Robbins, III | |
| D817,661 | S | 5/2018 | Valentin | |
| D840,174 | S | 2/2019 | Kraemer | |
| D863,196 | S | 10/2019 | Ariay | |
| D863,819 | S | 10/2019 | Ghiorghie | |
| 10,716,399 | B2 | 7/2020 | Brown et al. | |
| D894,634 | S | 9/2020 | Schluter | |
| 11,324,577 | B2 * | 5/2022 | Stopka | A61B 50/33 |
| D1,053,618 | S | 12/2024 | Zhang et al. | |

* cited by examiner

ORGANIZATIONAL KIT AND METHOD OF USE

TECHNICAL FIELD

This disclosure is directed to organizational assemblies and/or system, particularly modular organizational assemblies and/or system free from using separate fasteners.

BACKGROUND ART

In day-to-day activities, people deal with various difficulties and problems in organizing and arranging various types of items and objects in one or more support structures, such as drawers, table tops, etc. In these instances, items or objects may inadvertently or unwantedly shift or move inside of these support structures when people open and close these support structures.

To combat against these organizational issues, organizers and organizational systems are beneficial solutions in establishing organization when storing various gadgets, objects, and other items in a support structure. These organizers and organizational systems may be used in a wide variety of situations for de-cluttering and organizing various rooms, office spaces, shops, and other similar types of locations. In one instance, such organizers may be placed in drawers or cabinets of a kitchen for storing and organizing various kitchen gadgets, devices, and other relevant kitchen items. In another instance, such organizers may be placed in drawers or cabinets of a tool chest or similar support structure for storing and organizing various vehicle tools, bits, and other relevant vehicle items. As such, the utilization of these organizers provide users with quick and easy access of a desired gadget, object, or tool in a dedicated place.

However, while these organizers are commonly used with various types of support structures, these organizers include limitations to the users. In one instance, common drawer organizers define specific bays or partitions for storing items or devices. With such definite bays and partitions, users of these organizers are limited to size, shape, and configuration of these bays or partitions without further modification to the organizers or to the support structures. In another instance, common organizers are limited to specific goods or services for organizing devices or items in specific support structures. With such specificity, users must purchase and only use these specific organizers when organizing and arranging their devices, objects, and items which, inevitably, increases overall costs for these users. In yet another instance, common organizers are manufactured and/or built to specific dimensions for specific purposes. In this instance, these organizers are formed from materials that are meant to be maintained at predetermined structural configurations to maintain rigidity and strength when housing various types of objects or items.

SUMMARY OF THE INVENTION

The presently disclosed organizational assembly allows users to customize the organizational arrangement of the assembly based on the structural configuration of the support structure where the organizational assembly will be used. The presently disclosed organizational assembly enables user to selectively interlockingly engage one or more storage apparatuses of the organizational assembly with a self-supporting structure of the organizational assembly. The presently disclosed organizational assembly also enables users to cut and/or trim the self-supporting structure to match the structural configuration of a desired support structure by a set of first cutting grooves or a set of second cutting grooves defined in the self-supporting structure. As such, the organizational assembly discussed herein addresses some of the inadequacies of previously known organizers or organizational assemblies.

In one aspect, an exemplary embodiment of the present disclosure may provide a storage apparatus that is configured to selectively interlockably engageable with a self-supporting structure. The storage apparatus comprises a main body configured to store at least one object. The storage apparatus also comprises at least one connecting member extending outwardly from the main body. The at least one connecting member comprises: a first end operably engaged with the main body; a second end longitudinally opposite to the first end and spaced apart from the main body; and a shoulder positioned between the first end and the second end. The shoulder of the at least one connecting member is adapted to be selectively interlockably engagable with the self-supporting structure such that the self-supporting structure flexes around and conforms to the shoulder of at least one shoulder of each storage apparatus.

This exemplary embodiment or another exemplary embodiment may further include that the main body comprises: a storage wall configured to store the at least one object; a support wall operably engaged with the at least one connecting member and configured to contact the self-supporting structure; and a set of curvilinear sides positioned between the storage wall and the support wall and extending between two corners of a set of corners of the main body. This exemplary embodiment or another exemplary embodiment may further include that the at least one adhesive member operably engaging the at least one object with a portion of the storage wall of the main body. This exemplary embodiment or another exemplary embodiment may further include that the at least one connecting member comprises: a first diameter defined at the first end of the at least one connecting member; a second diameter defined at the second end of the at least one connecting member; and a third diameter defined at the shoulder of the at least one connecting member; wherein the third diameter is greater than the first diameter and the second diameter. This exemplary embodiment or another exemplary embodiment may further include that when the at least one connecting member engages with the self-supporting structure, the first end and the second end are free from engagement with the self-supporting structure. This exemplary embodiment or another exemplary embodiment may further include that the at least one connecting member comprises: a first exterior wall extending between the first end and the second end and defining a substantially concave shape; and wherein the first exterior wall frictionally fits with the self-supporting structure. This exemplary embodiment or another exemplary embodiment may further include that the at least one connecting member further comprises: a second exterior wall extending between the first end and the second end and defining a substantially planar shape; wherein the second exterior wall faces away from the first exterior wall. This exemplary embodiment or another exemplary embodiment may further include that the at least one connecting member further comprises: an interior wall extending from the second end to the main body; and a recess defined by the main body, the second exterior wall, and the interior wall. This exemplary embodiment or another exemplary embodiment may further include that the at least one connecting member further comprises: a first portion extending from the first end towards the second end; wherein the first portion is free from engagement with the self-supporting structure. This exemplary embodiment or another exemplary embodiment may further include that the at least one connecting member further comprises: a second portion extending from the first portion to the shoulder; wherein the second portion is free from engagement with the self-supporting structure. This exemplary embodiment or another exemplary embodiment may further include that the at least one connecting member further comprises: a first outer profile shape defined along the length of the second portion; and a second outer profile shape defined along the length of the shoulder; wherein the first outer profile shape and the second outer profile shape are different from one another. This exemplary embodiment or another exemplary embodiment may further include that the at least one connecting member further comprises: a convex outer profile shape defined along the length of the second portion; and a concave outer profile shape defined along the length of the shoulder. This exemplary embodiment or another exemplary embodiment may further include that the at least one connecting member further comprises: a first diameter defined at the first portion of the at least one connecting member; and a second diameter defined at the shoulder of the at least one connecting member; wherein the second diameter is greater than the first diameter. This exemplary embodiment or another exemplary embodiment may further include that the main body comprises: a first end; a second end operably engaged with the at least one connecting member and opposite to the first end; and at least one cavity defined in the main body between the first end and the second end; wherein the main body is configured to store the at least one object inside of the at least one cavity. This exemplary embodiment or another exemplary embodiment may further include at least another connecting member operably with a support wall of the main body; wherein the at least one connecting member and the at least another connecting member are spaced apart from one another along the support wall and selectively interlockably engagable with the self-supporting structure at different locations.

In another aspect, an exemplary embodiment of the present disclosure may provide a method. The method comprises steps of: introducing a storage apparatus with a self-supporting structure, the storage apparatus comprises: a main body configured to store at least one object; and at least one connecting member extending outwardly from the main body, the at least one connecting member comprising: a first end operably engaged with the main body; a second end longitudinally opposite to the first end and spaced apart from the main body; and a shoulder positioned between the first end and the second end; inserting the at least one connecting member into at least one interlocking point of the self-supporting structure; and interlocking the at least one connecting of the storage apparatus with the self-supporting structure at the at least one interlocking point such that the self-supporting structure flexes around and conforms to the shoulder of at least one shoulder of each storage apparatus.

This exemplary embodiment or another exemplary embodiment may further include that the step of interlocking the at least one connecting of the storage apparatus with the self-supporting structure at the at least one interlocking further includes that the first end of the at least one connecting member and the second end of the at least one connecting member are free from engaging with the self-supporting structure. This exemplary embodiment or another exemplary embodiment may further include steps of adhering at least one object with a storage wall of the main body; and contacting the self-supporting structure with a support wall of the main body, wherein the storage wall and the support wall face in opposing directions. This exemplary embodiment or another exemplary embodiment may further include steps of housing at least one object inside of a cavity defined by a first end of the main body, an interior wall of the main body, and a base wall of the main body; and contacting the self-supporting structure with a second end of the main body, wherein the cavity and the second end face in opposing directions. This exemplary embodiment or another exemplary embodiment may further include that the step of interlocking the at least one connecting of the storage apparatus with the self-supporting structure at the at least one interlocking point further includes that the exterior wall is frictionally fit with the self-supporting structure inside of the at least one interlocking point.

In yet another aspect, and exemplary embodiment of the present disclosure may provide an organizational kit. The organizational kit includes a self-supporting structure defining a plurality of interlocking openings and being made of a first material. The organizational kit also includes a plurality of storage apparatuses that is selectively interlockably engageable with the self-supporting at the plurality of interlocking openings and being made of a second material different than the first material; each storage apparatus comprises: a main body configured to store at least one object; and at least one connecting member extending outwardly from the main body, the at least one connecting member comprising: a first end operably engaged with the main body; a second end longitudinally opposite to the first end and spaced apart from the main body; and a shoulder positioned between the first end and the second end; wherein the shoulder of the at least one connecting member is configured to interlockably engage with the self-supporting structure inside of an interlocking opening of the plurality of interlocking openings such that the self-supporting structure flexes around and conforms to the shoulder of at least one shoulder of each storage apparatus.

This exemplary embodiment or another exemplary embodiment may further include that the self-supporting structure is made of a flexible, resilient material; and wherein each storage apparatus of the plurality of storage apparatuses is made of a rigid material. This exemplary embodiment or another exemplary embodiment may further include that the self-supporting structure comprises: a first end; a second end opposite to the first end; a first engagement surface extending between the first end and the second end; and a second engagement surface extending between the first end and the second end and facing in an opposite direction relative to the first base surface; wherein the plurality of storage apparatuses selectively interlockably engages at the first engagement surface or the second engagement surface. This exemplary embodiment or another exemplary embodiment may further include that the self-supporting structure further comprises: a first end; a second end opposite to the first end; a main layer extending between the first end and the second end; and a sub layer extending between the first end and the second end and extending outwardly from the main layer; wherein the plurality of storage apparatuses selectively interlockably engage at the main layer or at the sub layer. This exemplary embodiment or another exemplary embodiment may further include that the sub layer comprises: a set of first cutting grooves defined in the sub layer that extends between the first end of the self-supporting structure and the second end of the self-supporting. This exemplary embodiment or another exemplary embodiment may further include that the self-supporting structure further comprises: a first side positioned between the first end and the second end; a second side positioned between the first end and the second end and opposite to the first side; and wherein the sub layer further comprises: a set of second cutting grooves defined in the sub layer that extends between the first side and the second side; wherein the set of first cutting grooves and the set of second cutting grooves are defined perpendicular to one another. This exemplary embodiment or another exemplary embodiment may further include that the sub layer further comprises: a plurality of cutting tiles divided between the set of first cutting grooves and the set of second cutting grooves; wherein the plurality of cutting tiles is configured to provide predetermined cutting indices. This exemplary embodiment or another exemplary embodiment may further include that each cutting tile of the plurality of cutting tiles comprises: a length defined between at least one cutting groove of the set of first cutting grooves and at least another cutting groove of the set of first cutting grooves; and a width defined between at least one cutting groove of the set of second cutting grooves and at least another cutting groove of the set of second cutting grooves; wherein the length and the width of each cutting tile of the plurality of cutting tiles is equal to one another. This exemplary embodiment or another exemplary embodiment may further include that the self-supporting structure further comprises: a plurality of inner walls extending between the first engagement surface and the second engagement surface and defining the plurality of interlocking openings; wherein each inner wall of the plurality of inner walls is configured to frictionally fit with the at least one connecting member of each storage apparatus of the plurality of storage apparatuses. This exemplary embodiment or another exemplary embodiment may further include that each interlocking opening of the plurality of interlocking openings further comprises: a first diameter defined by each inner wall of the plurality of inner walls at each of the first engagement surface and the second engagement surface; and a second diameter defined by each inner wall of the plurality of inner walls at a location between the first engagement surface and the second engagement surface; wherein the first diameter is greater than the second diameter. This exemplary embodiment or another exemplary embodiment may further include that each interlocking opening of the plurality of interlocking openings further comprises: a third diameter defined by each inner wall of the plurality of inner walls at a location between the first engagement surface and the second engagement surface; wherein when the at least one connecting member of a storage apparatus of the plurality of storage apparatuses is free from engaging with the self-supporting structure, an inner wall of the plurality of inner walls defines the second diameter; and wherein when the at least one connecting member of the storage apparatus of the plurality of storage apparatuses interlockingly engages with the self-supporting structure, the inner wall of the plurality of inner walls transitions to the third diameter that is greater than the second diameter. This exemplary embodiment or another exemplary embodiment may further include that each storage apparatus of the plurality of storage apparatuses comprises: a storage wall configured to store the at least one object; a support wall operably engaged with the at least one connecting member and configured to contact the self-supporting structure; and a set of curvilinear sides positioned between the storage wall and the support wall and extending between two corners of a set of corners of the main body. This exemplary embodiment or another exemplary embodiment may further include that the at least one connecting member comprises: a first exterior wall extending between the first end and the second end and defining a substantially concave shape; wherein the first exterior wall frictionally fits with the self-supporting structure. This exemplary embodiment or another exemplary embodiment may further include that the at least one connecting member further comprises: a second exterior wall extending between the first end and the second end and defining a substantially planar shape; wherein the second exterior wall faces away from the first exterior wall. This exemplary embodiment or another exemplary embodiment may further include at least one adhesive member operably engaging the at least one object with a portion of the storage wall of the main body to hold at least one object with the storage wall. This exemplary embodiment or another exemplary embodiment may further include that the at least one connecting member further comprises: a first portion extending from the first end towards the second end; a second portion extending from the first portion to the shoulder; a first outer profile shape defined along the length of the second portion; and a second outer profile shape defined along the length of the shoulder; wherein the first outer profile shape and the second outer profile shape are different from one another. This exemplary embodiment or another exemplary embodiment may further include that the main body comprises: a passageway defined by a first interior wall and a second interior wall of the main body spaced apart from one another and positioned between the storage wall and the support wall; and a securement device that is partially housed inside of the passageway to hold a plurality of loose objects on the storage wall. This exemplary embodiment or another exemplary embodiment may further include that the main body comprises: a first end; a second end operably engaged with the at least one connecting member and opposite to the first end; and at least one cavity defined in the main body between the first end and the second end; wherein the main body is configured to store the at least one object inside of the at least one cavity.

In yet another aspect, and exemplary embodiment of the present disclosure may provide a method of storing at least one object with at least one storage apparatus. The method comprises steps of: placing a self-supporting structure of an organizational kit on a support structure, wherein the self-supporting structure defines a first length measured between a first end and a second end longitudinally opposite to the first end, and wherein the self-supporting structure defines a first width measured between a first side and a second side transversely opposite to the first side; selecting at least one storage apparatus from a plurality of storage apparatuses of the organizational kit with the self-supporting structure; selecting at least one interlocking opening defined by the self-supporting structure; inserting a connecting member of the at least one storage apparatus into the at least one interlocking opening; interlocking the connecting member with the self-supporting structure at the at least one interlocking opening; and storing the at least one object with the at least one storage apparatus.

This exemplary embodiment or another exemplary embodiment may further include steps of cutting the self-supporting structure along a cutting groove of a set of first cutting grooves or a set of second cutting grooves defined in the self-supporting structure, wherein the set of first cutting grooves extends between the first end and the second end and the set of second cutting grooves extends between the first side and the second side; and providing the self-supporting structure at a second length that is less than the first length or a second width that is less than the first width. This exemplary embodiment or another exemplary embodiment may further include that the step of storing the at least one object with the at least one storage apparatus further comprises: adhering the at least one object with a storage wall of a main body of the at least one storage apparatus; and contacting the self-supporting structure with a support wall of the main body, wherein the storage wall and the support wall face in opposing directions. This exemplary embodiment or another exemplary embodiment may further include that the step of storing the at least one object with the at least one storage apparatus further comprises: housing at least one object inside of a cavity defined by a first end of a main body, an inner wall of the main body, and a base wall of the main body; and contacting the self-supporting structure with a second wall of the main body, wherein the cavity and the second wall face in opposing directions. This exemplary embodiment or another exemplary embodiment may further include a step of assembling a storage apparatus between one of a first engagement surface of the self-supporting structure and a second engagement surface of the self-supporting structure. This exemplary embodiment or another exemplary embodiment may further include steps of disengaging the connecting member of the at least one storage apparatus from the at least one interlocking opening; selecting at least another interlocking opening defined by the self-supporting structure; inserting the connecting member of the at least one storage apparatus into the at least another interlocking opening; and interlocking the connecting member with the self-supporting structure at the at least another interlocking opening.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
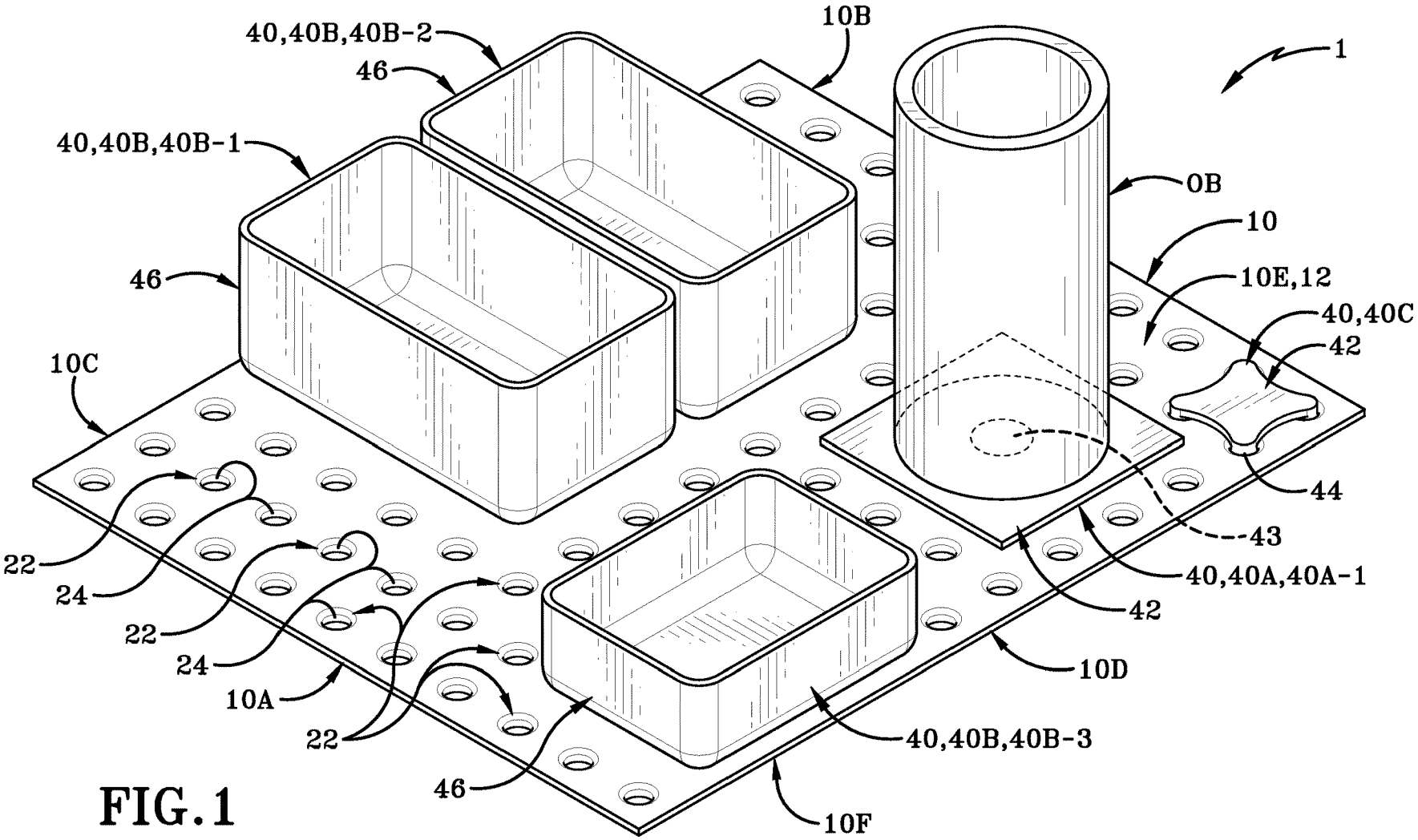
FIG. 1 is a front, top, side isometric perspective view of an organizational assembly in accordance with one aspect of the present disclosure, wherein a self-supporting structure of the organizational assembly is provided in a first orientation wherein a plurality of storage apparatuses is engaged with the self-supporting structure.
Figure 2:
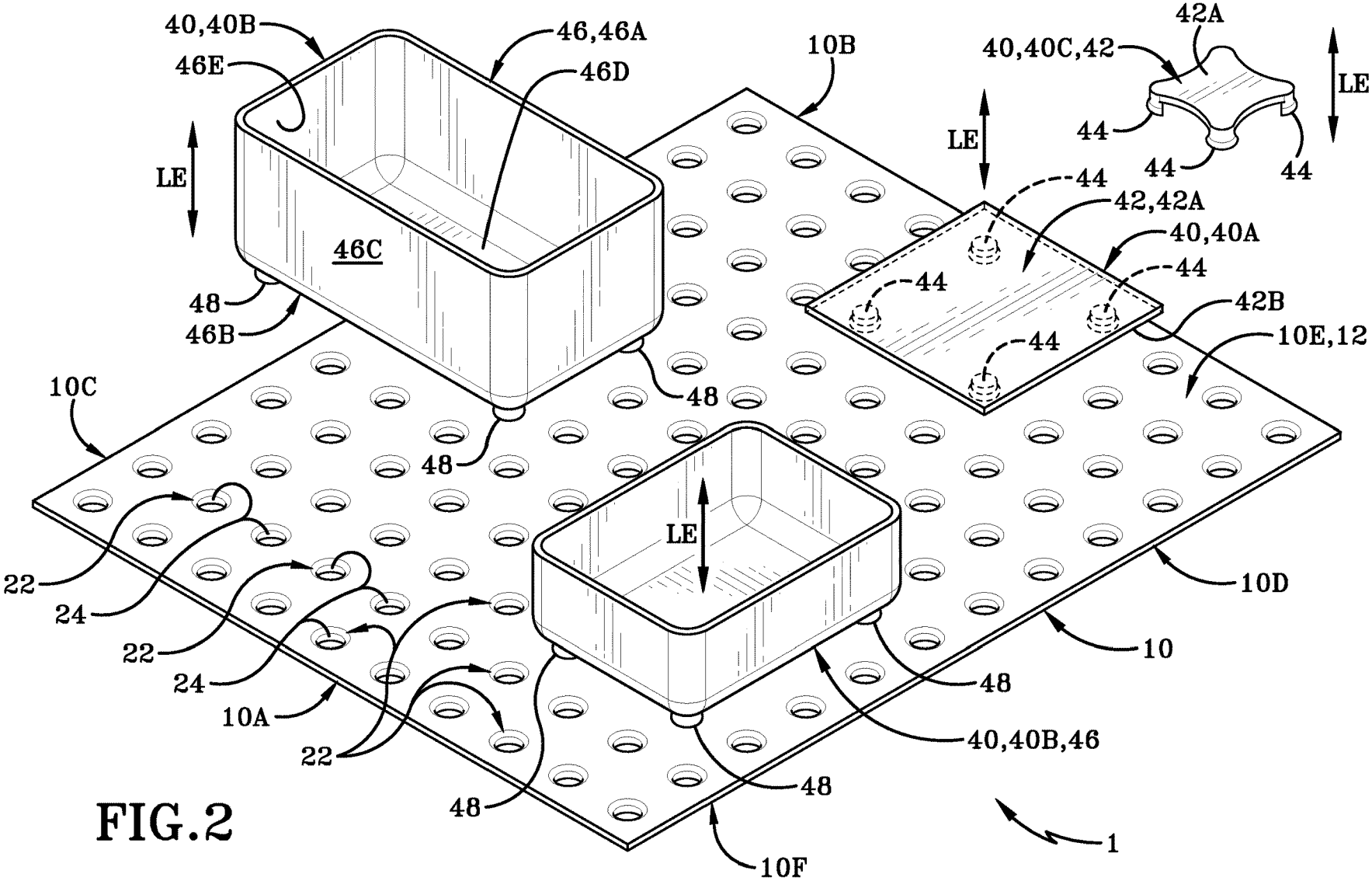
FIG. 2 is an operational view of the organizational assembly in the first orientation, wherein at least one storage apparatuses of a set of first storage apparatuses, at least two storage apparatus of a set of second storage apparatuses, and at least one third storage apparatus are being interlockingly engaged with the self-supporting structure of the organizational assembly.
Figure 3:
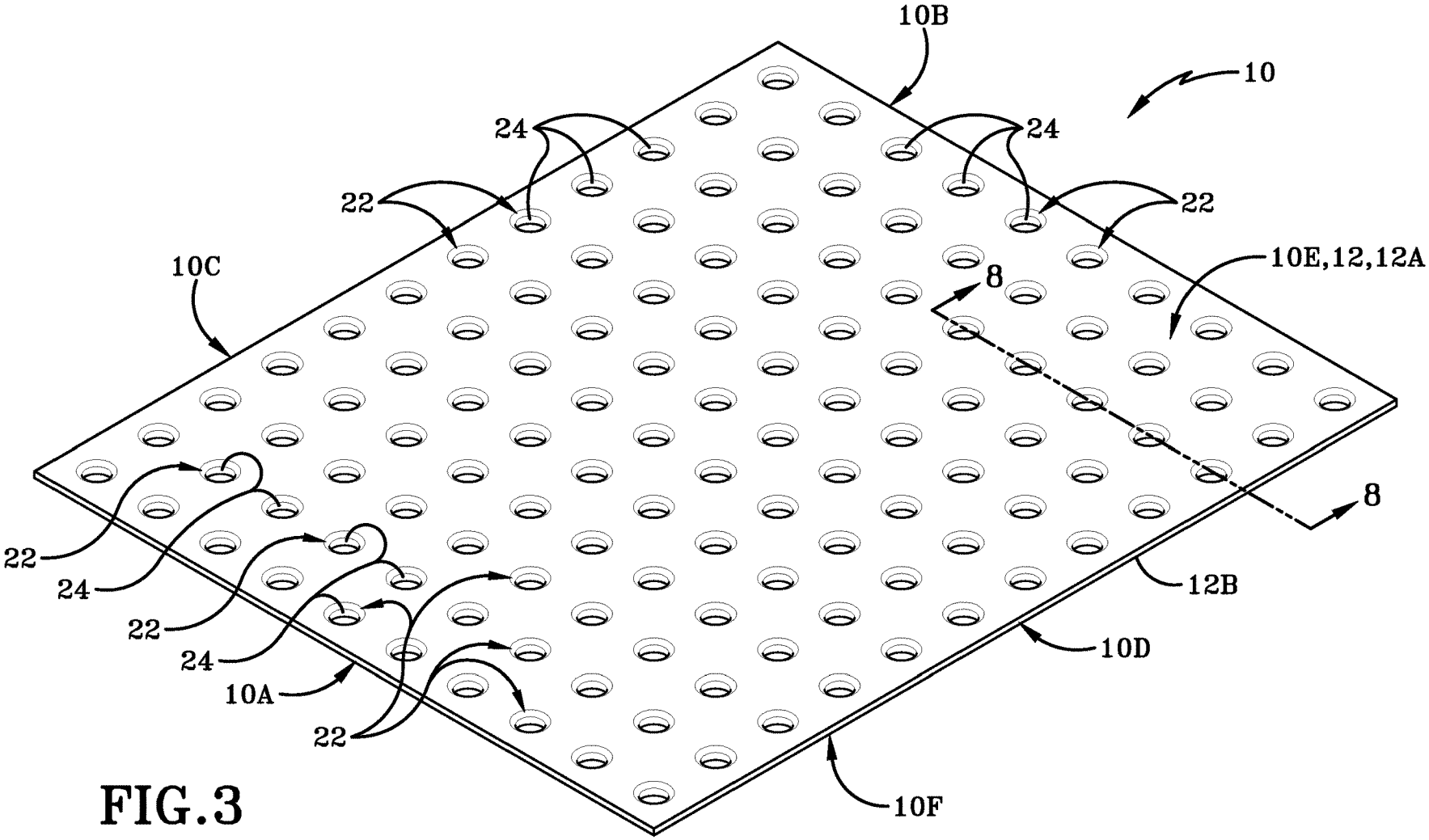
FIG. 3 is a front, top, side isometric perspective view of the self-supporting structure.

FIGS. 1-2 illustrate an organizational assembly or system that is generally referred to as reference numeral 1. Organizational assembly 1 is configured to be placed with or inside of a support structure 2 for enabling a user to selectively organize and store one or more objects with or inside of the support structure 2. As described in greater detail below, organizational assembly 1 enables a user to customize a desired organizational and/or storage arrangement as dictated by the implementation or application of organizational assembly 1, including the size, shape, and configuration of the support structure 2, the area or skill in which the organizational assembly 1 is being used for, and other various implementations or applications of the like. Such components and elements of organizational assembly 1 are discussed in greater detail below.

In the present embodiment, support structure 2 is illustrated as a table top or shelf for illustrative purposes. It should be understood that support structure 2 discussed and illustrated herein should not limit the uses and capabilities of organizational assembly 1 for enabling customized organizational arrangements desired by the user. In one instance, one or more organizational assemblies 1 may be used as drawer organizers that fit inside of a drawer where the organizational assemblies 1 prevents unwanted and/or unintentional movement of various items and objects between opening and closing movements of the drawer. In another instance, one or more organizational assemblies 1 may be used as a mechanic organizer that fits inside of a tool chest where the organizational assemblies 1 prevents unwanted and/or unintentional movement of tools or equipment between opening and closing movements of the drawer. In another instance, or ore more organizational assemblies 1 may be used as a travel organizer that fits inside of suitcase or luggage where the organizational assemblies 1 prevents unwanted and/or unintentional movement of personal travel items during travel.

Organizational assembly 1 includes a self-supporting structure or organizational mat 10 that operably engages with one or more support structures 2. In the present disclosure, organizational mat 10 operably engages with support structure 2. As discussed in greater detail below, organizational mat 10 is configured to enable one or more types of storage apparatuses of organizational assembly 1 to selectively interlockingly engage with the organizational mat 10 to maintain a desired arrangement of objects on or inside of support structure 2. Such components and features of organizational mat 10 is discussed in greater detail below.

Figure 5:
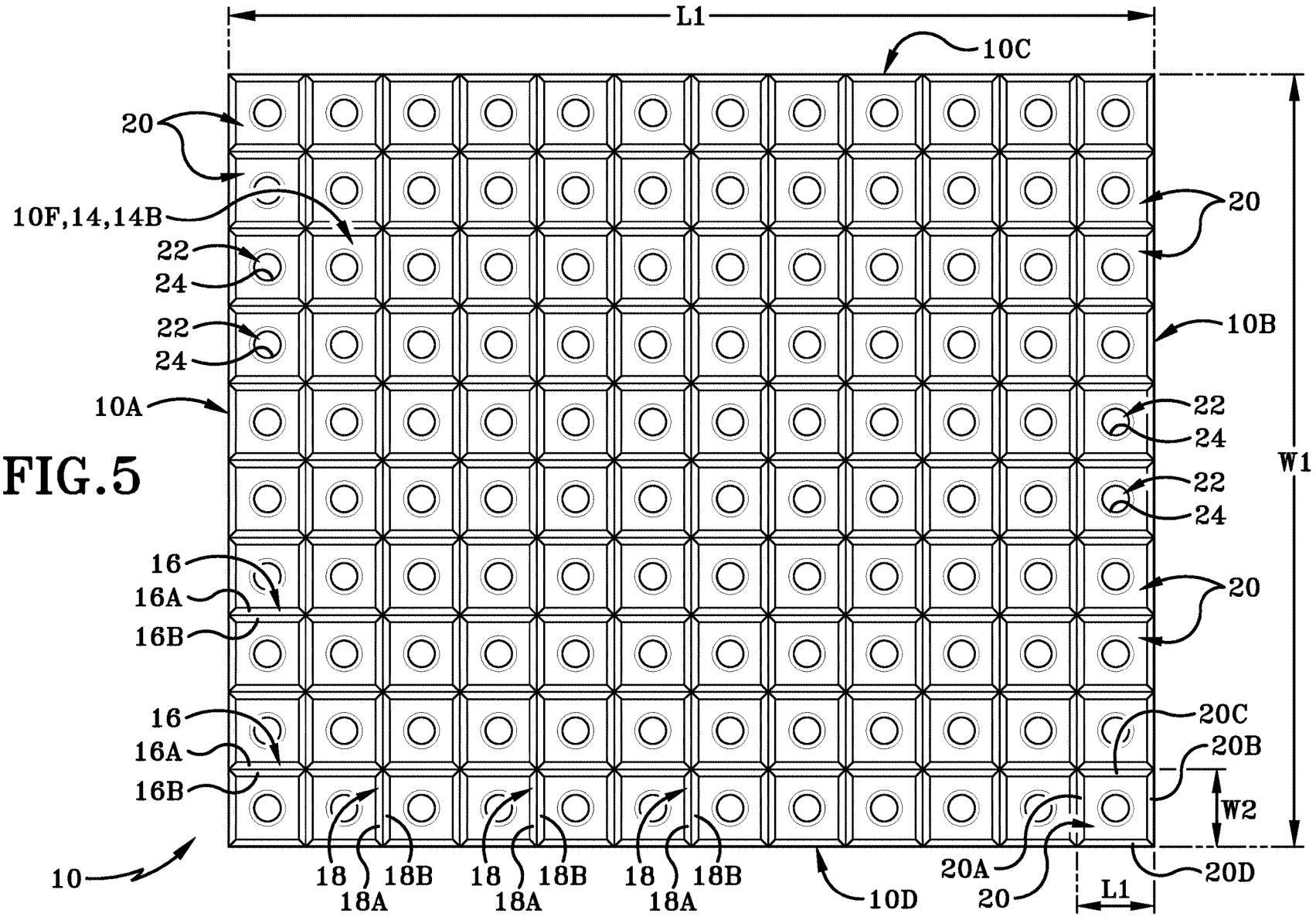
FIG. 5 is a bottom plan view of the self-supporting structure.

Organizational mat 10 includes a first end 10A, a second end 10B that is longitudinally opposite to the first end 10A, and a longitudinal axis defined therebetween (see FIG. 5). As best seen in FIG. 5, organizational mat 10 has a first length (denoted by double arrows labeled "L1") that is measured from the first end 10A to the second end 10B. Organizational mat 10 also includes a first side 10C that is positioned between the first end 10A and the second end 10B, a second side 10D that is positioned between the first end 10A and the second end 10B and is transversely opposite to the first side 10C, and a transverse axis defined therebetween (see FIG. 5). As best seen in FIG. 5, organizational mat 10 also has a first width (denoted by double arrows labeled "W1") that is measured from the first side 10C to the second side 10D.

In the present disclosure, the first length L1 of organizational mat 10 is greater than the first width W1 of organizational mat 10. In other exemplary embodiments, however, organizational mat discussed herein may define any suitable lengths and widths based on various considerations, including the shape, size, and configuration dictated for using the self-supporting structure. In one instance, a first length of an organizational mat 10 may be less than a first width of the self-supporting structure. In another instance, a first length of an organizational mat 10 may be equal with a first width of the self-supporting structure.

Figure 8:
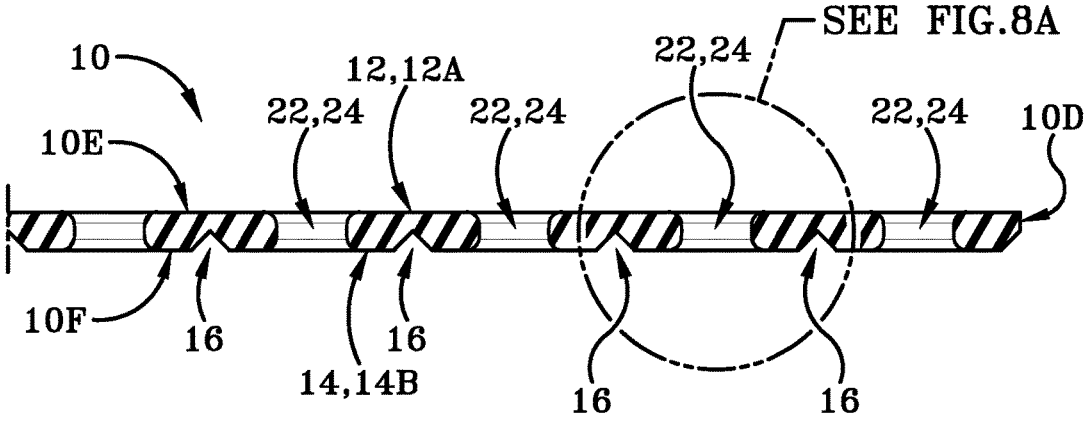
FIG. 8 is a partial cross-sectional view of the self-supporting structure taken in the direction of line 8A-8A in FIG. 3.

Organizational mat 10 may also include a first engagement surface 10E that is positioned vertically above the first end 10A, the second end 10B, the first side 10C, and the second side 10D when viewed from a side elevation view (see FIGS. 2 and 8). Organizational mat 10 may also include a second engagement surface 10F that is positioned vertically below the first end 10A, the second end 10B, the first side 10C, and the second side 10D when viewed from a side elevation view (see FIGS. 2 and 8). In the present disclosure, the second engagement surface 10F is vertically opposite to the first engagement surface 10E and faces in an opposing direction relative to the first engagement surface 10E. Organizational mat 10 also defines a first thickness (denoted by double arrows labeled "T1" in FIG. 8A) that is measured between the first engagement surface 10E and the second engagement surface 10F. Such first thickness T1 of organizational mat 10 will be discussed in greater detail below.

Figure 1A:
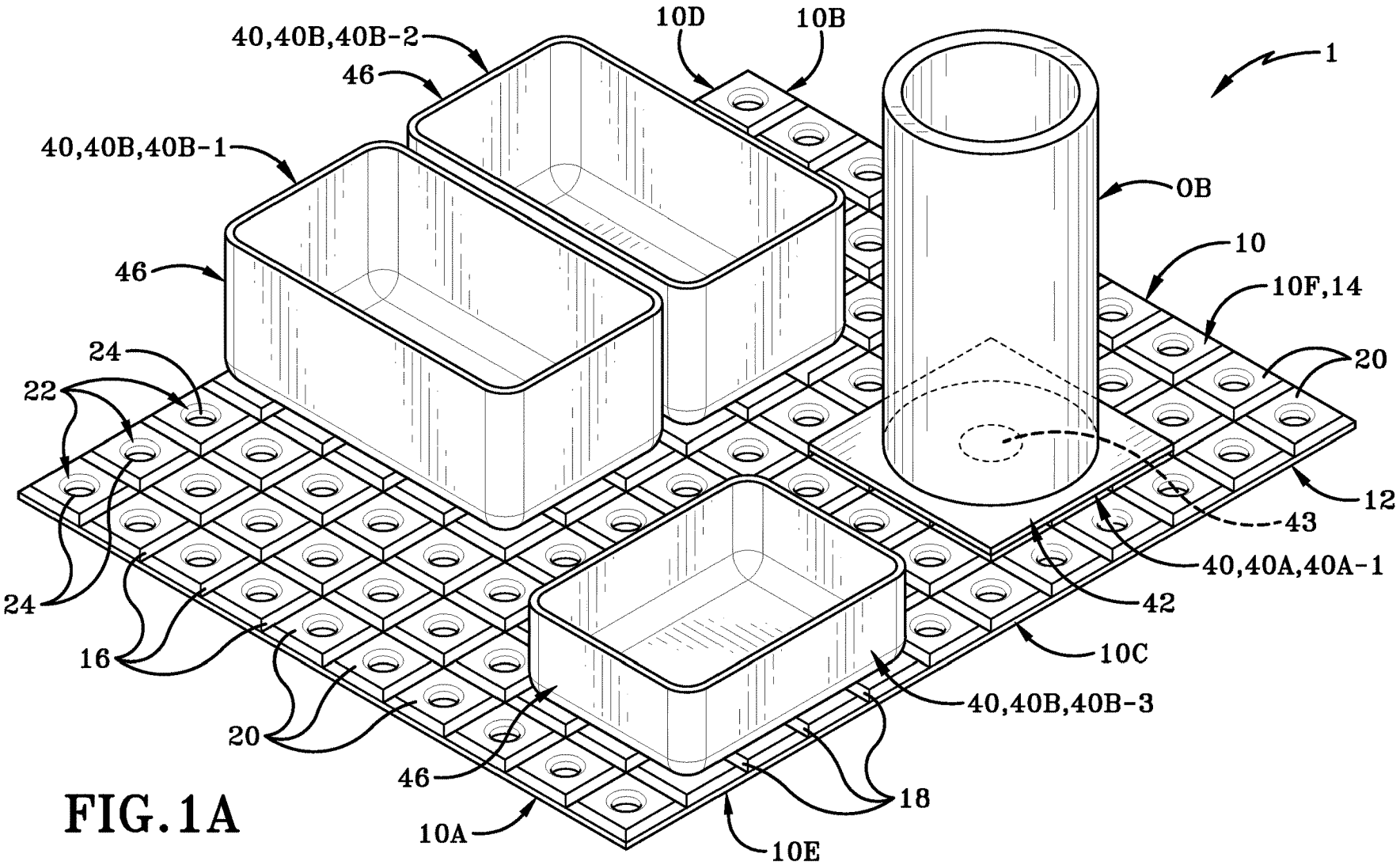
FIG. 1A is a front, bottom, side isometric perspective view of the organizational assembly, wherein the self-supporting structure of the organizational assembly is provided in a second orientation wherein the plurality of storage apparatuses is engaged with the self-supporting structure.
Figure 10:
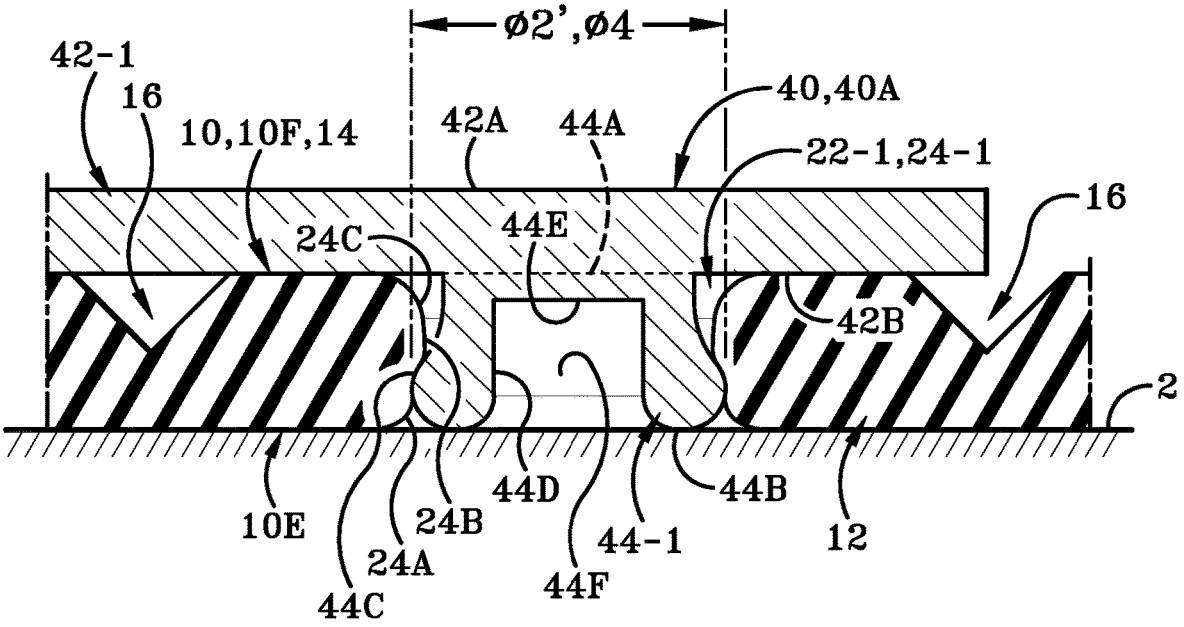
FIG. 10 is another operational view similar to FIG. 9B, but the at least one connecting member of the storage apparatus is interlockingly engaging with the self-supporting structure in the second orientation opposite to the first orientation.

In the present disclosure, each of the first engagement surface 10E and second engagement surface 10F is configured to be used in a first orientation and a second orientation. In the first orientation, and as best seen in FIGS. 1 and 2, the first engagement surface 10E is configured to interlockingly engage with one or more storage apparatuses of organizational assembly 1 while the second engagement surface 10F operably engages with the support structure 2. In the second orientation, and as best seen in FIGS. 1A and 10, the second engagement surface 10F is configured to interlockingly engage with one or more storage apparatuses of organizational assembly 1 while the first engagement surface 10E operably engages with the support structure 2. In essence, the organizational mat 10 is reversibly engageable at the first engagement surface 10E and the second engagement surface 10F based on structural configuration of organizational mat 10. It is preferred, however, that the first engagement surface 10E is configured to interlockingly engage with one or more storage apparatuses of organizational assembly 1 while the second engagement surface 10F operably engages with the support structure 2.

Figure 4:
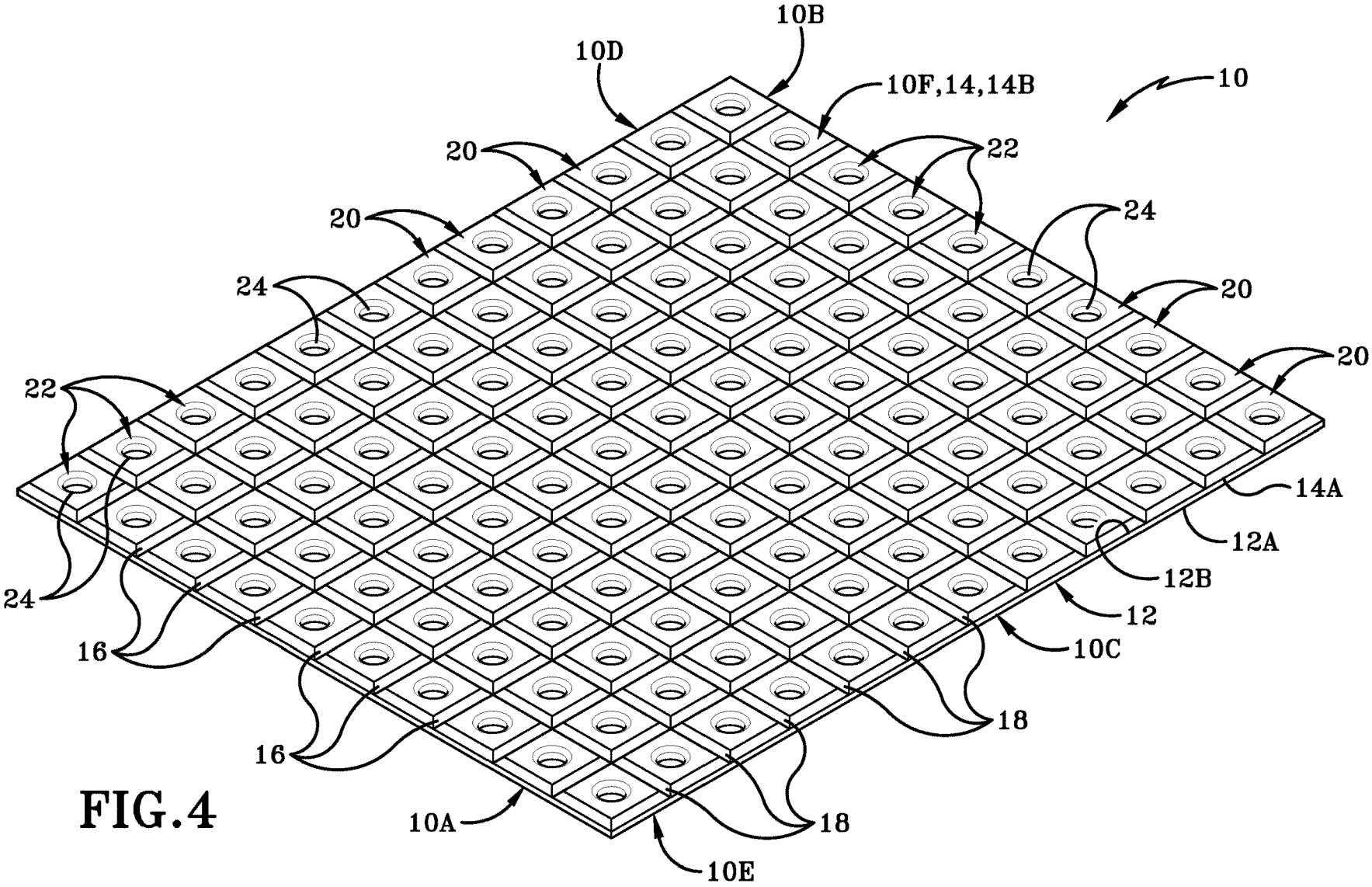
FIG. 4 is a front, bottom, side isometric perspective view of the self-supporting structure.

Organizational mat 10 may be formed of a main layer 12. As best seen in FIG. 4, main layer 12 includes a first surface 12A that is a part of the first engagement surface 10E and a second surface 12B that is vertically opposite to the first surface 12A and faces away from first surface 12A. Organizational mat 10 may also be formed of a sub layer 14 that extends outwardly from main layer 12. As best seen in FIG. 4, sub layer 14 includes a first surface 14A that forms with the second surface 12B of main layer 12 and a second surface 14B that is vertically opposite to the first surface 14A and faces away from first surface 14A; the second surface 14B is also part of the second engagement surface 10F. In the present disclosure, main layer 12 and sub layer 14 collectively constitute organizational mat 10 to form a single, monolithic member. In other exemplary embodiments, main layer 12 and sub layer 14 may also be separate components that are engaged with one another to form organizational mat 10.

Figure 8A:
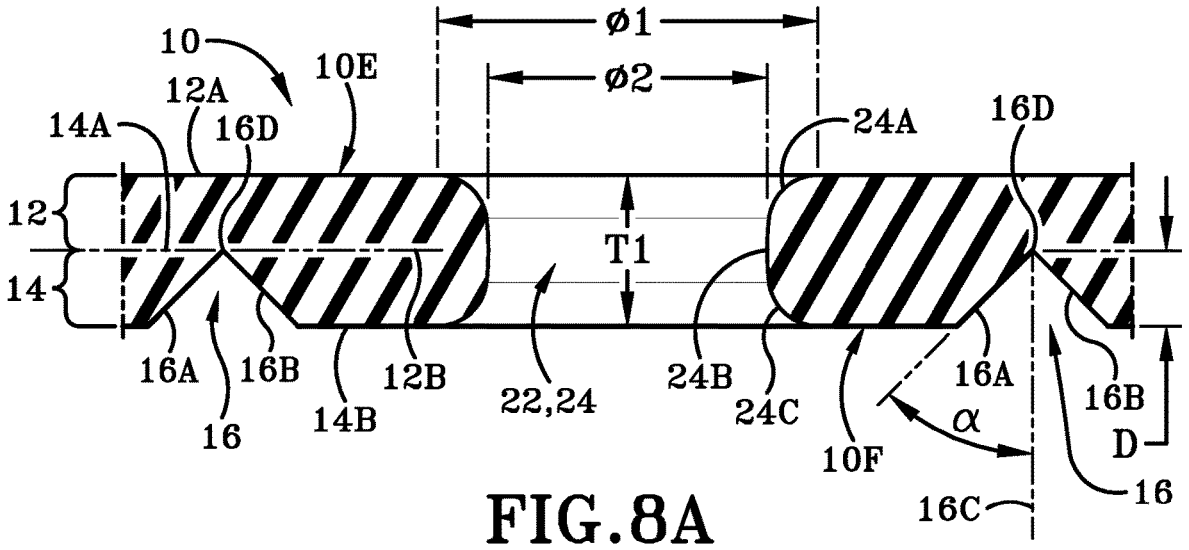
FIG. 8A is an enlargement of the highlighted region shown in FIG. 8.

Organizational mat 10 may also defines a set of first cutting grooves 16 in sub layer 14. As best seen in FIGS. 4-5, each cutting groove of the set of first cutting grooves 16 extends longitudinally between the first end 10A and the second end 10B. In the present disclosure, the set of first cutting grooves 16 is defined by a first set of walls 16A and a second set of walls 16B adjacent to the first set of walls 16A that extends longitudinally between the first end 10A and the second end 10B. As best seen in FIG. 8A, each wall of the first set of walls 16A is defined at an angle (denoted by double arrows labeled "a" in FIG. 8A) that is measured from a central axis 16C extending vertically through an intersection point 16D of a wall of the first set of walls 16A and a wall of the second set of walls 16B. Similarly, each wall of the second set of walls 16B is defined at angle $\alpha$ that is measured from a central axis 16C extending vertically through an intersection point or valley 16D of a wall of the first set of walls 16A and a wall of the second set of walls 16B; as such, each wall of the second set of walls 16B is defined at a congruent angle relative to a central axis 16C.

Each cutting groove of the set of first cutting grooves 16 is also defined at a depth (denoted by double arrows labeled "D" in FIG. 8A) that is measured from the second engagement surface 10F to the intersection points 16D of each wall of the first set of walls 16A and each wall of the second set of walls 16B.

In the present disclosure, each wall of the first set of walls 16A and each wall of the second set of walls 16B collectively define the set of first cutting grooves 16 and are defined at an acute angle relative to a central axis 16C extending vertically through an intersection point 16D of a wall of the first set of walls 16A and a wall of the second set of walls 16B. In other exemplary embodiments, however, each wall of a first set of walls and each wall of a second set of walls collectively defining a set of first cutting grooves may be defined at an any suitable angle relative to a central axis extending vertically through an intersection point of a wall of the first set of walls and a wall of the second set of walls. In one instance, each wall of a first set of walls and each wall of a second set of walls collectively defining a set of first cutting grooves may be defined at an obtuse angle relative to a central axis extending vertically through an intersection point of a wall of the first set of walls and a wall of the second set of walls. In one instance, each wall of a first set of walls and each wall of a second set of walls collectively defining a set of first cutting grooves may be defined at a range of angles from about 1 degree up to about 89 degrees relative to a central axis extending vertically through an intersection point of a wall of the first set of walls and a wall of the second set of walls.

In the present disclosure, each cutting groove of the set of first cutting grooves 16 may define a triangular and/or V-shape configuration when viewed from a side elevation view based on the structural configurations of the first set of walls 16A and the second set of walls 16B collectively defining the set of first cutting grooves 16. In other exemplary embodiments, however, each cutting groove of a set of first cutting grooves may define any suitable two dimensional shape based on the structural configurations of a first set of walls and a second set of walls collectively defining the set of first cutting grooves. Examples of suitable two dimensional shapes to define each cutting groove of a set of first cutting grooves includes U-shaped, square or truncated U-shaped, round, curvilinear, and other suitable two dimensional shapes to define each cutting groove of a set of first cutting grooves.

In the present disclosure, the depth D of each cutting groove of the set of first cutting grooves 16 is about one-half the size of the first thickness T1 of the organizational mat 10. In other exemplary embodiments, however, a depth of each cutting groove of a first set of cutting grooves may be any suitable dimension relative to a first thickness of a self-supporting structure. In one exemplary embodiment, a depth of each cutting groove of a first set of cutting grooves may be in a range of about one-quarter the size of a first thickness of a self-supporting structure up to about one-half the size of a first thickness of a self-supporting structure. In another exemplary embodiment, a depth of each cutting groove of a first set of cutting grooves may be in a range of about one-half the size of a first thickness of a self-supporting structure up to about two-thirds the size of a first thickness of a self-supporting structure. In another exemplary embodiment, a depth of each cutting groove of a first set of cutting grooves may be less than one-quarter the size of a first thickness of a self-supporting structure.

Organizational mat 10 may also defines a set of second cutting grooves 18 in sub layer 14. As best seen in FIGS. 4-5, each cutting groove of the set of second cutting grooves 18 extends transversely between the first side 10C and the second side 10D. Similar to the set of first cutting grooves 16, the set of second cutting grooves 18 is defined by a first set of walls 18A and a second set of walls 18B adjacent to the first set of walls 18A that extends transversely between the first side 10C and the second side 10D. In the present disclosure, the first set of walls 18A and the second set of walls 18B collectively defining the set of second cutting grooves 18 are perpendicular to the first set of walls 16A and the second set of walls 16B collectively defining the set of first cutting grooves 16 to create a plurality of tiles 20 arranged in a grid pattern, which is discussed in greater detail below.

It should be understood that the first set of walls 18A and the second set of walls 18B collectively defining the set of second cutting grooves 18 are substantially similar to the first set of walls 16A and a second set of walls 16B collectively defining the set of first cutting grooves 16. As such, each wall of the first set of walls 18A is defined at a substantially similar angle to each wall of the first set of walls 16A that is measured from a central axis extending vertically through an intersection point of a wall of the first set of walls 18A and an adjacent wall of the second set of walls 18B. Similarly, each wall of the second set of walls 18B is defined at a substantially similar angle to each wall of the second set of walls 18B is measured from a central axis extending vertically through an intersection point of a wall of the first set of walls 18A and a wall of the second set of walls 18B. Each cutting groove of the set of second cutting grooves 18 is also defined at a depth that is substantially similar to the depth of each cutting groove of the set of first cutting grooves 16 measured from the second engagement surface 10F to the intersection points 16D of each wall of the first set of walls 16A and each wall of the second set of walls 16B.

Organizational mat 10 also includes a plurality of cutting tiles 20 formed in the sub layer 14. As mentioned previously, the plurality of cutting tiles 20 are created due to the organizational mat 10 defining the set of first cutting grooves 16 and the set of second cutting grooves 18. As best seen in FIG. 5, each cutting tile of the plurality of cutting tiles includes a first end 20A, a second end 20B longitudinally opposite to the first end 20A, and a second length (denoted by double arrows labeled "L2" in FIG. 5) measured between the first end 20A and the second end 20B. Still referring to FIG. 5, each cutting tile of the plurality of cutting tiles also includes a first side 20C, a second side 20D transversely opposite to the first side 20C, and a second width (denoted by double arrows labeled "W2" in FIG. 5) measured between the first side 20C and the second side 20D.

In the present disclosure, the second length L2 of each cutting tile of the plurality of cutting tiles 20 is measured at about one inch, and the second width W2 of each cutting tile of the plurality of cutting tiles 20 is measured at about one inch; as such, each cutting tile of the plurality of cutting tiles 20 defines one square inch. In other exemplary embodiments, however, each cutting tile of a plurality of cutting tiles may have any suitable length and width based on various considerations, including the number of cutting grooves defined in a self-supporting structure, positioning of cutting grooves defined in a self-supporting structure, the size, shape, and configuration of a self-supporting structure, and other various considerations of the like.

Such inclusion of the set of first cutting grooves 16 and the set of second cutting grooves 18 to form the grid of tiles 20 is considered advantageous at least because the user may customize the size of the organizational mat 10 for support structure 2 by cutting and/or trimming the organizational mat 10 to a desired size. In one instance, the user of organizational assembly 1 may shorten the length L1 of the organizational mat 10 at one inch increments by simply cutting the organizational mat 10 with a cutting tool (e.g., scissors, knife, etc.) along a desired cutting groove of the set of first cutting grooves 16. In another instance, the user of organizational assembly 1 may also shorten the width W1 of the organizational mat 10 at one inch increments by simply cutting the organizational mat 10 with a cutting tool (e.g., scissors, knife, etc.) along a desired cutting groove of the set of second cutting grooves 18. In yet another instance, the user of organizational assembly 1 may also shorten the length L1 and the width W1 of the organizational mat 10 at one inch increments by simply cutting the organizational mat 10 with a cutting tool (e.g., scissors, knife, etc.) along a desired cutting groove of the set of first cutting grooves 16 and along another desired cutting groove of the set of second cutting grooves 18. With such usability, the user is enabled to customize the size of the organizational mat 10 by simply cutting and/or trimming the organizational mat 10 to fit dimensions and/or surface area of the support structure 2.

Organizational mat 10 also defines a plurality of interlocking openings 22. As best seen in FIGS. 1-5 and 8-8A, each interlocking opening of the plurality of interlocking openings 22 extends entirely through organizational mat 10 between the first engagement surface 10E and the second engagement surface 10F. In the present disclosure, the first engagement surface 10E and the second engagement surface 10F are in fluid communication with one another at each interlocking opening of the plurality of interlocking openings 22. As discussed in greater detail below, each interlocking opening of the plurality of interlocking openings 22 is configured to receive a connecting member of one or more storage apparatuses of organizational assembly 1 to interlockingly engage the one or more storage apparatuses with self-supporting structure (see FIGS. 2, 9A-9B, and 10).

Organizational mat 10 includes a plurality of inner walls 24 that defines the plurality of interlocking openings 22 in organizational mat 10. As best seen in FIG. 8A, each inner wall of the plurality of inner walls 24 includes first fillet or rounded portion 24A that extends downwardly from the first engagement surface 10E of organizational mat 10 to a vertical or upright portion 24B of the respective inner wall 24. Still referring to FIG. 8A, each inner wall of the plurality of inner walls 24 also includes a second fillet or rounded portion 24C that extends upwardly from the second engagement surface 10F of organizational mat 10 to the upright portion 24B of the respective inner wall 24.

Still referring to FIG. 8A, each inner wall of the plurality of inner walls 24 also defines a first diameter (denoted by double arrows labeled Ø1 in FIG. 8A) along the upright portion 24B of each inner wall of the plurality of inner walls 24. Each inner wall of the plurality of inner walls 24 also defines a second diameter (denoted by double arrows labeled Ø2 in FIG. 8A) at each of the first fillet portion 24A and the second fillet portion 24C of each inner wall of the plurality of inner walls 24. In the present disclosure, the second diameter Ø2 of each inner wall of the plurality of inner walls 24 is greater than the first diameter Ø1 of each inner wall of the plurality of inner walls 24. Such difference in diameters for each inner wall of the plurality of inner walls 24 creates a countersunk configuration for each interlocking opening of the plurality of interlocking openings 22.

In the present disclosure, organizational mat 10 is made of a flexible and resilient material that enables the organizational mat 10 to expand and contract based on interaction with one or more connecting members of one or more storage apparatuses of organizational assembly 1. As best seen in FIGS. 8A-9A, each inner wall of the plurality of inner walls 24 is maintained at the second diameter Ø2 when the organizational mat 10 is free from interacting or engaging with one or more connecting members of one or more storage apparatuses of organizational assembly 1. As discussed in greater detail below, each inner wall of the plurality of inner walls 24 expands outwardly to a diameter that is greater than the second diameter Ø2 but less than the first diameter Ø1 when the organizational mat 10 interacts or engages with one or more connecting members of one or more storage apparatuses of organizational assembly 1 (see FIG. 9B). When one or more connecting members of one or more storage apparatuses of organizational assembly 1 are removed from and disengages with a respective inner wall of the plurality of inner walls 24, the respective inner wall of the plurality of inner walls 24 contracts back to the original shape and diameter (i.e., second diameter Ø2).

In the present disclosure, organizational mat 10 defines a rectangular shape when viewed from a top plan view (see FIG. 5). It should be understood that the shape of the organizational mat 10 illustrated herein should not limit or hinder other suitable shapes that may define organizational mat 10. Examples of suitable two-dimensional shapes that may define a self-supporting structure described herein include circular, square, triangular, pentagonal, hexagonal, octagonal, and other suitable shapes for defining a self-supporting structure.

Organizational assembly 1 also includes a plurality of storage apparatuses 40 that interlockingly engages with organizational mat 10 by the plurality of interlocking openings 22. In the present disclosure, the plurality of storage apparatuses 40 includes a set or type of first storage apparatuses 40A and a set or type of second storage apparatuses 40B that interlockingly engage with organizational mat 10 by the plurality of interlocking openings 22. Each of the set of first storage apparatuses 40A and the set of second storage apparatuses 40B are discussed in greater detail below.

With respect to the set of second storage apparatuses 40A, each storage apparatus of the set of second storage apparatuses 40A also includes a main body 42. As best seen in FIGS. 1-2 and 7-7B, main body 42 includes a storage wall 42A, a support wall 42B that is vertically opposite to the storage wall 42A, and a longitudinal axis defined therebetween. In the present disclosure, the storage wall 42A is configured to store one or more objects (labeled "OB" in FIGS. 1-2) by at least one adhesive material or element 43 (see FIG. 1). In the present disclosure, the support wall 42B is also configured to interface with the first engagement surface 10E or the second engagement surface 10F when the storage apparatus 40A interlockingly engages with the organizational mat 10.

In the present disclosure, adhesive material 43 illustrated herein may be any suitable material or element that secures at least one or more objects with the storage wall 42A. In one instance, adhesive material may be a permanent adhesive that fixedly maintains at least one object with a storage wall of a storage apparatus such that the at least one object and the storage apparatus are a unitary component. In this instance, such permanent adhesives include glue, epoxy, contact cement, silicone rubber, construction adhesives, and other similar types of permanent adhesives. In another instance, adhesive material may be a temporary or removable adhesive that temporarily maintains at least one object with a storage wall of a storage apparatus such that the at least one object may be removed from storage apparatus. In this instance, such temporary adhesives include hook and loop fasteners, removable tape, and other various types of temporary adhesives.

Each storage apparatus of the set of first storage apparatuses 40A also includes at least one connecting member 44 that operably engages with the main body 42. In the present disclosure, each storage apparatus of the set of first storage apparatus 40A includes four connecting member 44 that operably engages with the main body 42. As discussed in greater detail below, each connecting member 44 is configured to interlockingly engage with an inner wall of the plurality of inner walls 24 inside of an interlocking opening of the plurality of interlocking openings 22. Such features of a connecting member 44 of each storage apparatus of the set of first storage apparatuses 40A are discussed in greater detail below.

Figure 7:
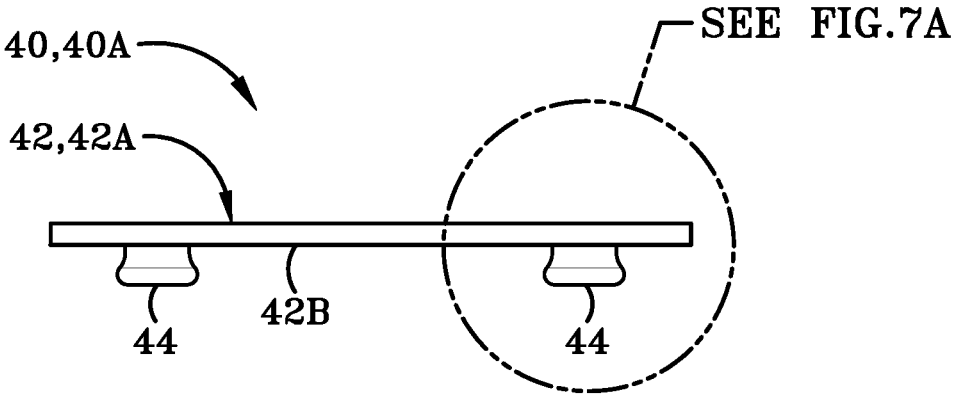
FIG. 7 is a side elevation view of a storage apparatus of the set of first storage apparatuses in accordance with another aspect of the present disclosure.
Figure 7A:
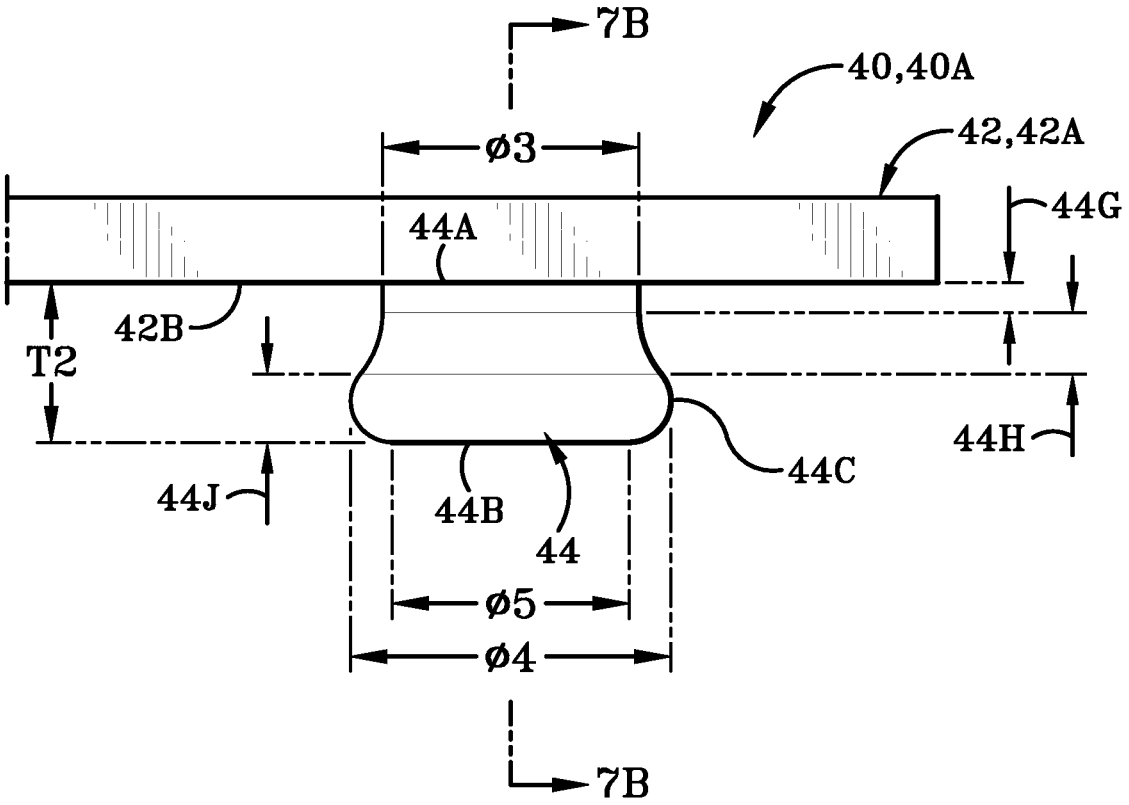
FIG. 7A is an enlargement of the highlighted region shown in FIG. 7.
Figure 7B:
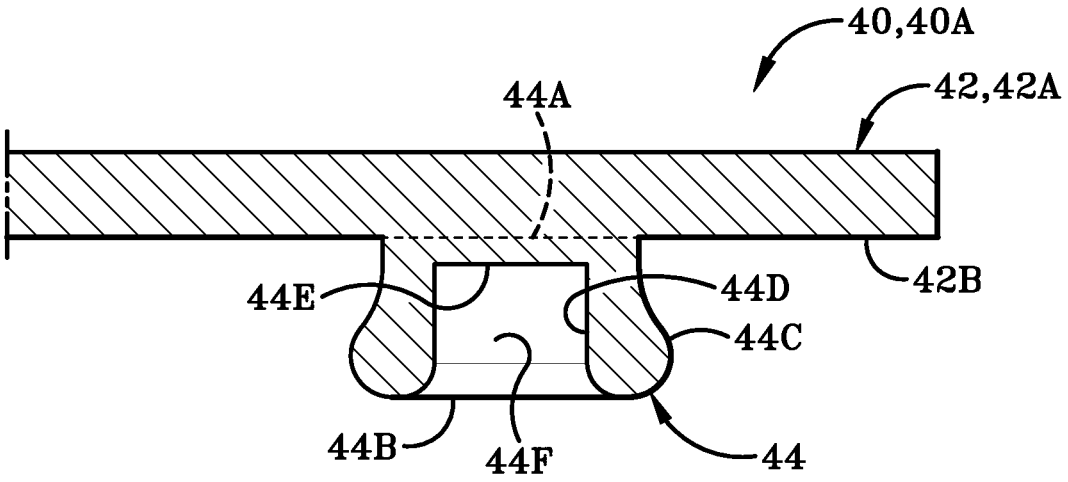
FIG. 7B is a partial cross-sectional view of the storage apparatus taken in the direction of line 7B-7B in FIG. 7A.

As best seen in FIGS. 7A-7B, each connecting member 44 includes a first end 44A that operably engages with the support wall 42B, a second end 44B that is vertically opposite to the first end 44A, and a longitudinal axis defined therebetween. Each connecting member 44 also has a second thickness or height (denoted by double arrows labeled "T2" in FIG. 7A) that is measured between the first end 44A and the second end 44B. In the present disclosure, the second thickness "T2" of each connecting member 44 is equal with the first thickness "T1" of the organizational mat 10 so that each connecting member 44 interlockingly engages with a portion of an inner wall of the plurality of inner walls 24 and is completely housed inside of an interlocking opening of the plurality of interlocking openings 22.

Still referring to FIGS. 7A-7B, each connecting member 44 also defines a exterior wall 44C that extends between the first end 44A and the second end 44B. In the present disclosure, the exterior wall 44C has a substantially parabolic or concave shape when viewed from a side elevation (see FIG. 7A) or a cross-section (see FIGS. 7B and 9A-9B). Each connecting member 44 also includes an interior wall 44D that extends vertically upwardly from the second end 44B to a base wall 44E. In the present disclosure, the interior wall 44D and the base wall 44E collectively define a recess 44F inside of the connecting member 44. With this configuration, exterior wall 44C and interior wall 44D may be capable of flexing and/or bending inwardly towards recess 44F when connecting member 44 engages with an inner wall of the plurality of walls 24.

Still referring to FIGS. 7A-7B, each connecting member 44 also includes a first portion 44G that extends downwardly from the first end 44A towards the second end 44B. Each connecting member 44 also includes a second portion 44H that extends downwardly from the first portion 44G towards the second end 44B. Each connecting member 44 also includes a third portion or shoulder 44J that extends downwardly from the second portion 44H to the second end 44B. Each of the first portion 44G, the second portion 44H, and the shoulder 44J collectively define one or more of the exterior wall 44C, the interior wall 44D, and the base wall 44E.

Still referring to FIGS. 7A-7B, exterior wall 44C of each connecting member 44 may define various diameters along the length of connecting member 44. As best seen in FIG. 7A, exterior wall 44C defines a third diameter (denoted by double arrows labeled "Ø3" in FIG. 7A) at the first end 44A. Exterior wall 44C also defines a fourth diameter (denoted by double arrows labeled "Ø4" in FIG. 7A) at a location between the first end 44A and the second end 44B at the shoulder 44J. In the present disclosure, exterior wall 44C transitions outwardly from the third diameter Ø3 to the fourth diameter Ø4 when moving downwardly from the first end 44A towards the second end 44B such that the fourth diameter Ø4 is greater than the third diameter Ø3. Exterior wall 44C also defines a fifth diameter (denoted by double arrows labeled "Ø5" in FIG. 7A) at the second end 44B. In the present disclosure, exterior wall 44C transitions inwardly from the fourth diameter Ø4 to the fifth diameter Ø5 when moving downwardly from the shoulder 44J to the second end 44B such that the fourth diameter Ø4 is greater than the fifth diameter Ø5.

Figure 9A:
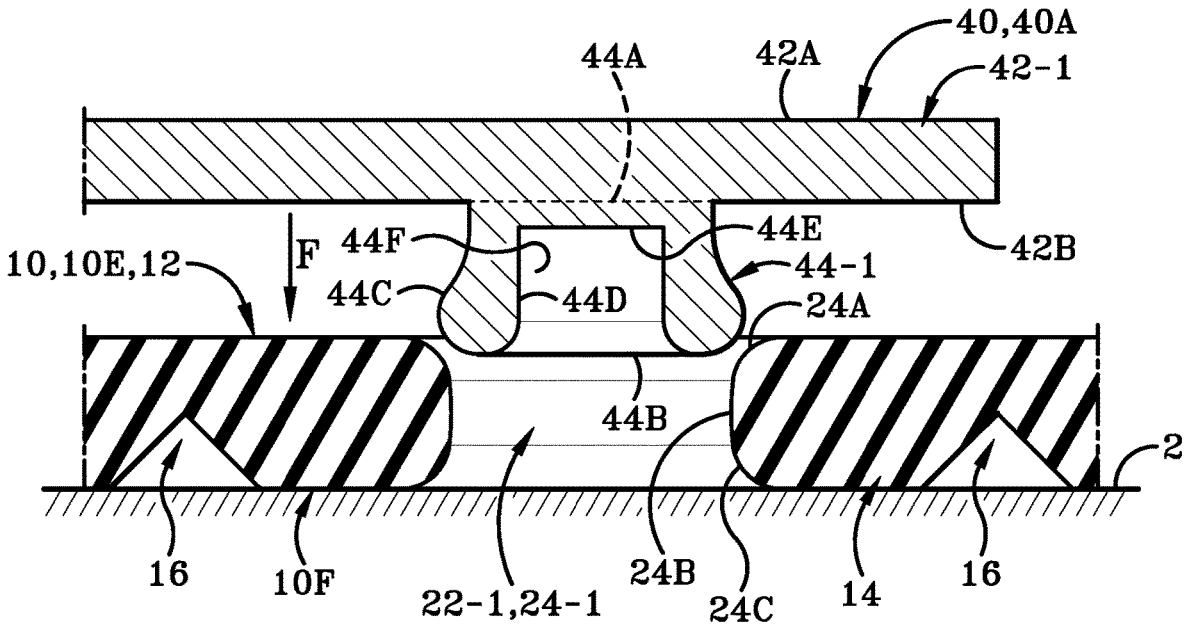
FIG. 9A is an operational view of at least one connecting member of a storage apparatus of the set of second storage apparatuses being inserted into at least one interlocking opening defined in the self-supporting structure.
Figure 9B:
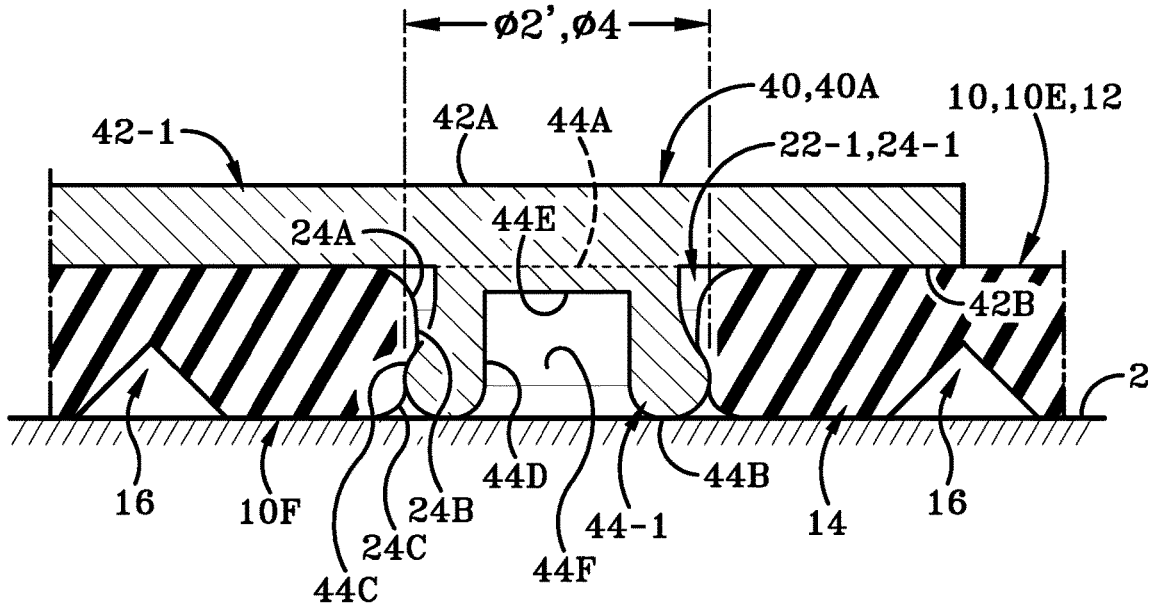
FIG. 9B is another operational view similar to FIG. 9A, but the at least one connecting member of the storage apparatus is interlockingly engaging with the self-supporting structure inside of the at least one interlocking opening.

Such configuration of the connecting members 44 of each storage apparatus of the set of first set of storage apparatuses 40A in considered advantageous at least because such configuration enables the connecting member 44 to interlockingly engage with the plurality of inner walls 24 inside of the plurality of interlocking openings 22. As best seen in FIG. 9B, the fourth diameter Ø4 of the exterior wall 44C is greater than the second diameter Ø2 of an inner wall of the plurality of inner walls 24 to create an interlocking configuration and/or frictional fit between a storage apparatus of the set of first storage apparatuses 40A and the organizational mat 10. Upon engagement, the inner wall of the plurality of inner walls 24 expands radially outward to conform to the structural shape of the exterior wall 44C of the connecting member 44 to create an interlocking configuration and/or frictional fit between the a storage apparatus of the set of first storage apparatuses 40A and the organizational mat 10 (see FIG. 9B).

Figure 6:
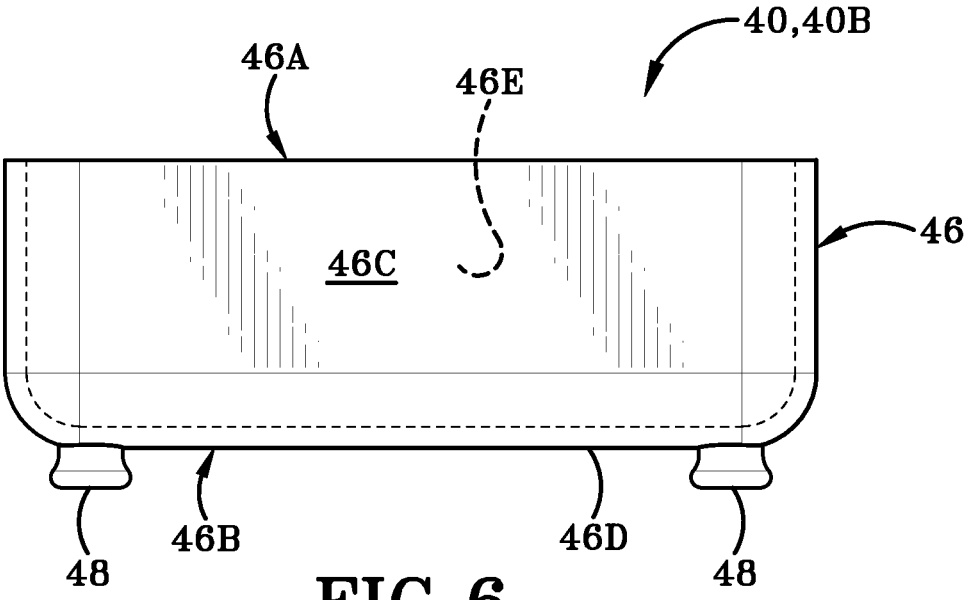
FIG. 6 is a side elevation view of a storage apparatus of the set of second storage apparatuses in accordance with one aspect of the present disclosure.

With respect to the set of second storage apparatuses 40B, each storage apparatus of the set of second storage apparatuses 40B includes a main body 46. As best seen in FIGS. 1-2 and 6, main body 46 includes a first end 46A, a second end 46B that is vertically opposite to the first end 46A, and a longitudinal axis defined therebetween. Main body 46 also includes at least one interior wall 46C that extends vertically downward from the second end 46B to at least one base wall 46D. Main body 46 also includes at least one cavity 46E that is collectively defined by the at least one interior wall 46C and the at least one base wall 46D. In the present disclosure, main body 46 includes a single interior wall 46C and a single base wall 46D that collectively define a single cavity 46E. In operation, main body 46 is configured to house and hold one or more objects inside of cavity 46E for organizational purposes.

Each storage apparatus of the set of second storage apparatuses 40B also includes at least one connecting member 48 that operably engages with the main body 46. In the present disclosure, each storage apparatus of the set of second storage apparatus 40B includes four connecting member 44 that operably engages with the main body 46. As discussed in greater detail below, each connecting member 48 is configured to interlockingly engage with an inner wall of the plurality of inner walls 24 inside of an interlocking opening of the plurality of interlocking openings 22.

In the present disclosure, the connecting members 48 provided with each storage apparatus of the set of second storage apparatuses 40B are identical to the connecting members 44 provided with each storage apparatus of the set of first storage apparatuses 40B discussed above. As such, connecting member 48 is configured to interlockingly engage with an inner wall of the plurality of inner walls 24 inside of an associated interlocking opening of the plurality of interlocking openings 22.

In the present disclosure, the plurality of interlocking openings 22 defined by the organizational mat 10 and the plurality of connecting members 44, 48 of the set of first storage apparatuses 40A and the set of second storage apparatuses 40B define rounded and/or curvilinear cross-sectional shapes. It should be understood that a plurality of interlocking openings defined by a self-supporting structure and a plurality of connecting members of a set of first storage apparatuses and a set of second storage apparatuses may define any suitable cross-sectional shapes that match or complementary with one another to create interlocking engagement. Examples of suitable cross-sectional shapes for a plurality of interlocking openings defined by a self-supporting structure and a plurality of connecting members of a set of first storage apparatuses and a set of second storage apparatuses include triangular, square, rectangular, trapezoidal, pentagonal, hexagonal, octagonal, and other suitable cross-sectional shapes for a plurality of interlocking openings defined by a self-supporting structure and a plurality of connecting members of a set of first storage apparatuses and a set of second storage apparatuses that match or complementary with one another to create interlocking engagement.

The structural configuration of the organizational mat 10 and the plurality of storage apparatuses 40 is considered advantageous at least because a user may assembly one or more storage apparatuses of the plurality of storage apparatuses 40 in a custom arrangement dictated by the implementation of organizational assembly 1. When interlocking one or more storage apparatuses of the set of first storage apparatuses 40A, the user may adhere and/or affix one or more objects (e.g., object OB) to the storage wall 42A of the one or more storage apparatuses of the set of first storage apparatuses 40A. When interlocking one or more storage apparatuses of the set of second storage apparatuses 40B, the user may house one or more loose objects inside cavities 46E of the one or more storage apparatuses of the set of second storage apparatuses 40B. As discussed previously, user may also cut the organizational mat 10 to a desired length and/or width that matches with the dimensions or surface area of a desired support structure.

Having now described the components of organizational assembly 1, methods of assembling and use organizational assembly 1 are discussed in greater detail below.

Prior to assembly one or more storage apparatuses of the plurality of storage apparatuses 40, user may cut or trim the organizational mat 10 to a desired length and width that forms and/or matches to a desired support structure. As such, user may utilize any suitable cutting tool to cut and/or trim the organizational mat 10 to a desired length and width that forms and/or matches with the dimensions or surface area of a desired support structure. In one instance, the user may only shorten the length L1 of the organizational mat 10 at one inch increments by simply cutting along a desired cutting groove of the set of first cutting grooves 16. In another instance, the user may only shorten the width W1 of the organizational mat 10 at one inch increments by simply cutting along a desired cutting groove of the set of second cutting grooves 18. In yet another instance, the user of organizational assembly 1 may shorten the length L1 and the width W1 of the organizational mat 10 at one inch increments by simply cutting along a desired cutting groove of the set of first cutting grooves 16 and along a desired cutting groove of the set of second cutting grooves 18. Once the organizational mat 10 is trimmed to a desired length and/or width, user may then place the organizational mat 10 with support structure 2.

Once trimmed, the user may then begin inserting one or more storage apparatuses of the plurality of storage apparatuses 40 into the organizational mat 10 for interlocking engagement. In one instance, and as best seen in FIG. 9A, user may align a connecting member 44-1 of a storage apparatus 40A-1 of the set of first storage apparatuses 40A over an interlocking opening 22-1 of the plurality of interlocking opening 22. Once aligned, user may then apply a pushing force on the main body 42-1 of the storage apparatus 40A-1 such that the at least one connecting member 44 interlockingly engages with an inner wall 24-1 defining the at least one interlocking opening 22-1; such pushing force applied to the storage apparatus 40-1 is denoted by arrows labeled "F" in FIG. 9A. As the connecting member 44-1 is pressed downwardly into the interlocking opening 22-1, the inner wall 24-1 begins to expand from the second diameter Ø2 to an expanded second diameter Ø2' (see FIG. 9B). In this operation, the inner wall 24-1, particularly the upright portion 24B-1, expands and conforms to the curvilinear shape of the connecting member 44-1 due to the fourth diameter Ø4 of the exterior wall 44C-1 being greater than the second diameter Ø2. Such expansion of the inner wall 24-1 enables the interlocking engagement and/or frictional fit between the organizational mat 10 and the storage apparatus 40-1. The user may continue to assert the pushing force against storage apparatus 40A-1 until the support wall 42B directly abuts the first engagement surface 10E.

Prior to or after interlockingly engaging the storage apparatus 40A-1 with the organizational mat 10, user may adhere one or more objects with the storage apparatus 40A-1. As best seen in FIG. 1, object OB is adhered with the storage wall 42A of main body 42 of storage apparatus 40A-1 by adhesive material 43. Such adhesion between the storage apparatus 40A-1 and the object OB maintains the object OB with the storage apparatus 40A-1 at the location where the storage apparatus 40A-1 is interlocked with the organizational mat 10.

Once the storage apparatus 40A-1 is equipped with the organizational mat 10 via interlocking engagement, user may then interlock other storage apparatuses of the plurality of storage apparatuses 40 with the organizational mat 10. As best seen in FIGS. 1 and 2, user may selectively interlockingly engage at least three storage apparatuses 40B-1, 40B-2, 40B-3 of the set of second storage apparatuses 40B with the organizational mat 10 using the same method and technique mentioned previously when selectively interlockingly engage the storage apparatuses 40A-1 with organizational mat 10.

It should be appreciated that while the user may selectively interlockingly engage storage apparatuses 40 with organizational mat 10, the user may also remove and/or disengage one or more storage apparatuses of the plurality of storage apparatuses 40 from the organizational mat 10. As best seen in FIGS. 2 and 10, user may selectively interlockingly disengage the storage apparatus 40A-1 of the set of first storage apparatuses 40A from the organizational mat 10 and/or the three storage apparatuses 40B-1, 40B-2, 40B-3 of the set of second storage apparatuses 40B for various reasons desired by the user, including removing at least one storage apparatus from the organizational mat 10, moving and interlocking at least one storage apparatus to a different location on the organizational mat 10, and other similar reasons. Such selectively interlockingly engagement with the organizational mat 10 and selectively interlockingly disengagement from the organizational mat 10 is denoted by double arrows labeled "IE" in FIG. 2.

Organizational assembly 1 may also include a third storage apparatus generally labeled with reference numeral 40C (see FIGS. 11-15). Third storage apparatus 40C of organizational assembly 1 is similar to each storage device of the set of first storage apparatuses 40A described above and illustrated in FIGS. 7-7B, except as detailed below. It should be understood that while organizational assembly 1 only includes a single third storage apparatus 40C illustrated herein, one or more third storage apparatuses 40C may be included with organizational assembly 1.

Similar to each storage apparatus of the set of first storage apparatuses 40A, the third storage apparatus 40C includes a main body 42 that has a storage wall 42A, a support wall 42B that is vertically opposite to the storage wall 42A, and a longitudinal axis defined therebetween. In the present disclosure, the storage wall 42A is configured to store one or more objects by at least one adhesive material or element (such as adhesive element 43 shown in FIG. 1). In the present disclosure, the support wall 42B is also configured to interface with the first engagement surface 10E or the second engagement surface 10F when the storage apparatus 40A interlockingly engages with the organizational mat 10.

Figure 13:
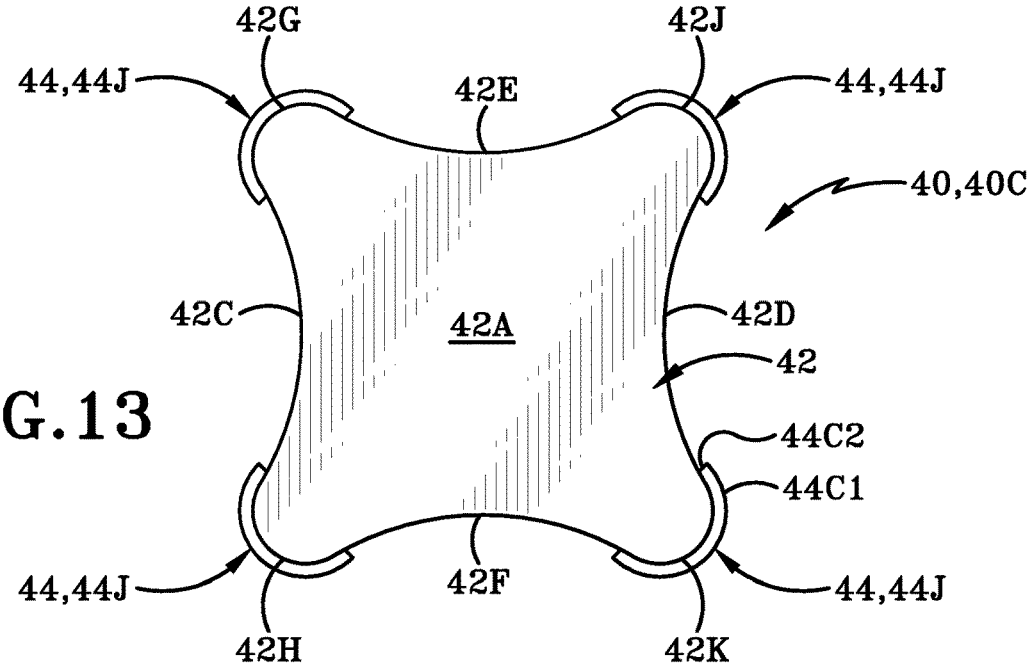
FIG. 13 is a top plan view of the third storage apparatus.
Figure 14:
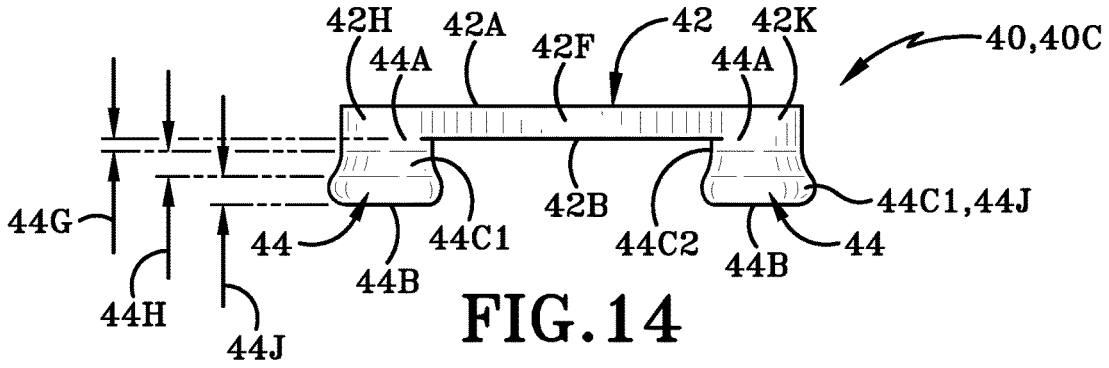
FIG. 14 is a side elevation view of the third storage apparatus.
Figure 15:
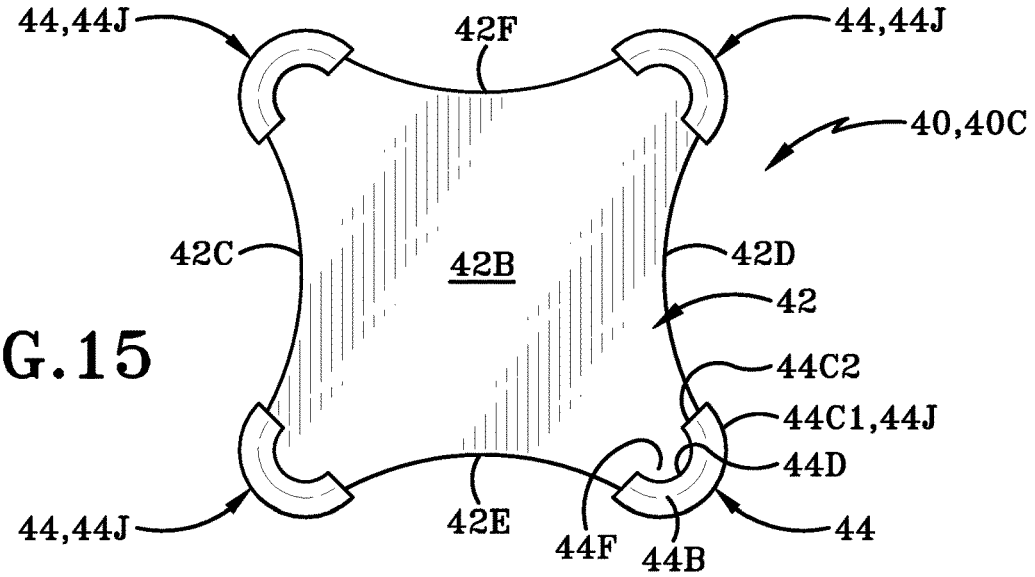
FIG. 15 is a bottom plan view of the third storage apparatus.

However, the main body 42 of the third storage apparatus 40C includes a first side 42C that defines a curvilinear shape and/or convex shape when viewed from a top plan view (see FIG. 13). Main body 42 of third storage apparatus 40C also includes a second side 42D that is opposite to the first side 40C and also defines a curvilinear shape and/or convex shape when viewed from a top plan view (see FIG. 13). Main body 42 of storage apparatus 40C also includes a third side 42E that extends between the first side 42C and the second side 42D and also defines a curvilinear shape and/or convex shape when viewed from a top plan view (see FIG. 13). Main body 42 of storage apparatus 40C also includes a fourth side 42F that extends between the first side 42C and the second side 42D, is opposite to the third side 42E, and defines a curvilinear shape and/or convex shape when viewed from a top plan view (see FIG. 13).

The curvilinear shape of the first side 42C, the second side 42D, the third side 42E, and the fourth side 42F may be considered advantageous at least because the curvilinear shapes of the first side 42C, the second side 42D, the third side 42E, and the fourth side 42F provide distinct areas and/or locations where a user may grip and/or pinch the main body 42 of the third storage apparatus 40C when connecting the third storage apparatus 40C with the self-supporting structure 10 or disconnecting the third storage apparatus 40C with the self-supporting structure 10. The curvilinear shape of the first side 42C, the second side 42D, the third side 42E, and the fourth side 42F may be considered advantageous at least because the curvilinear shape reduces the overall footprint and/or area of the main body 42 of the third storage apparatus 40C while still being engaged with the self-supporting structure 10 at four openings of the plurality of interlocking openings 22.

Main body 42 of third storage apparatus 40C also includes a first rounded corner 42G that is positioned at the intersection of the first side 42C and the third side 42E. Main body 42 of third storage apparatus 40C also includes a second rounded corner 42H that is positioned at the intersection of the first side 42C and the fourth side 42F. Main body 42 of third storage apparatus 40C also includes a third rounded corner 42J that is positioned at the intersection of the second side 42D and the third side 42E. Main body 42 of third storage apparatus 40C also includes a fourth rounded corner 42K that is positioned at the intersection of the second side 42D and the fourth side 42F.

Similar to each storage apparatus of the set of first storage apparatuses 40A, third storage apparatus 40C also includes at least one connecting member 44 that operably engages with the main body 42. As discussed above, each connecting member 44 is configured to interlockingly engage with an inner wall of the plurality of inner walls 24 inside of an interlocking opening of the plurality of interlocking openings 22 of organizational mat 10 such that the inner wall of the plurality of inner walls 24 expands and conforms to the shape of the connecting member 44 (see FIGS. 9A-9B). In the present disclosure, however, third storage apparatus 40C includes four connecting member 44 that operably engages with the main body 42 at the first rounded corner 42G, the second rounded corner 42H, the third rounded corner 42J, and the fourth rounded corner 42K.

Figure 11:
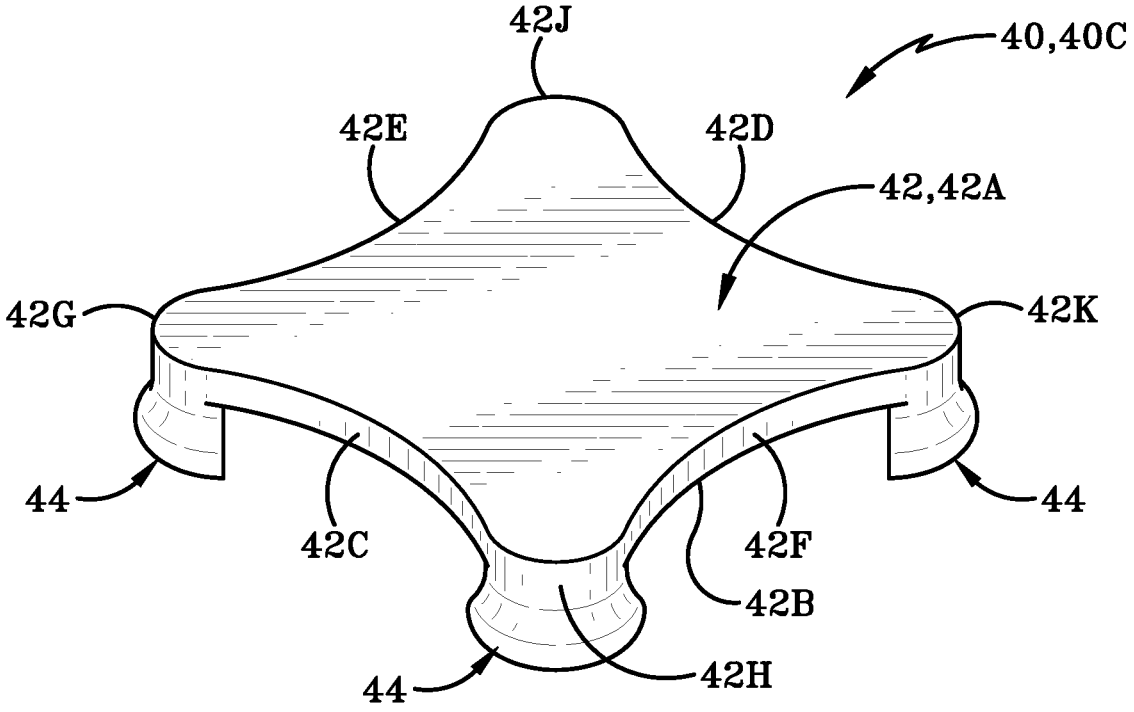
FIG. 11 is a front, top, first side isometric perspective view of the third storage apparatus of the organizational assembly.
Figure 12:
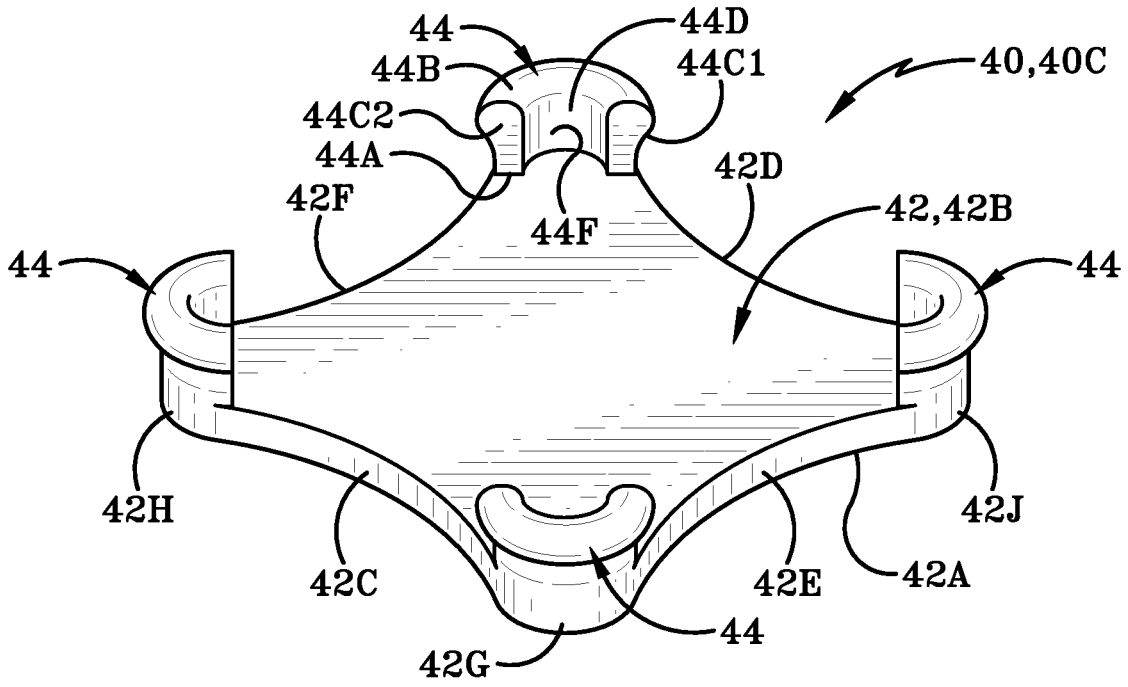
FIG. 12 is a front, bottom, second side isometric perspective view of the third storage apparatus.

As best seen in FIGS. 11-12, each connecting member 44 includes a first end 44A that operably engages with the support wall 42B, a second end 44B that is vertically opposite to the first end 44A, and a longitudinal axis defined therebetween. Each connecting member 44 also has a second thickness or height (similar to second thickness denoted by double arrows labeled "T2" for each storage apparatus of the set of first storage apparatuses 40A) that is measured between the first end 44A and the second end 44B. In the present disclosure, the second thickness of each connecting member 44 is equal with the first thickness "T1" of the organizational mat 10 so that each connecting member 44 interlockingly engages with a portion of an inner wall of the plurality of inner walls 24 and is completely housed inside of an interlocking opening of the plurality of interlocking openings 22.

However, in this embodiment, each connecting member 44 of the third storage apparatus 44 includes a first exterior wall 44C1 that extends downwardly from the first end 44A and the second end 44B. In the present disclosure, the first exterior wall 44C1 defines a substantially concave shape or non-linear shape when viewed from a side elevation view (see FIG. 14) or a bottom plan view (see FIG. 15). Each connecting member 44 of the third storage apparatus 44 also includes a second exterior wall 44C2 that also extends downwardly from the first end 44A to the second end 44B. In the present disclosure, the second exterior wall 44C2 defines a planar or linear shape when viewed from a side elevation view (see FIG. 14) or a bottom plan view (see FIG. 15). In the present embodiment, each connecting member of the set of connecting members 44 of the third storage apparatus 40C defines an arcuate shape along the outer profile of each connecting member 44 when viewed from a bottom plan view (see FIG. 15) as compared to the connecting members 44 of each storage apparatus of the set of first storage apparatuses 40A defining a circular shape along the outer profile of each connecting member 44. Stated differently, each connecting member of the set of connecting members 44 of the third storage apparatus 40C defines an arcuate shape along the outer profile of each connecting member 44 along the first exterior wall 44C1 and the second exterior wall 44C2 when viewed from a bottom plan view (see FIG. 15)

Each connecting member 44 of the third storage apparatus 44 also includes an interior wall 44D that extends vertically downward from the first end 44A or support surface 42B of main body 42 to the second end 44B. In the present disclosure, the interior wall 44D defines a recess 44F inside of the connecting member 44 that is defined by the the first exterior wall 44C1, the first interior wall 44D, and the support wall 42B of the main body 42.

Each connecting member 44 of the third storage apparatus 44 also includes a first portion 44G that extends downwardly from the first end 44A towards the second end 44B. Each connecting member 44 also includes a second portion 44H that extends downwardly from the first portion 44G towards the second end 44B. Each connecting member 44 also includes a shoulder 44J that extends downwardly from the second portion 44H to the second end 44B. Each of the first portion 44G, the second portion 44H, and the shoulder 44J collectively define one or more of the first exterior wall 44C1, the second exterior wall 44C2, and the interior wall 44D. Similar to the connecting members 44 of the first storage apparatus 40A mentioned above, the shoulder 44J defines a diameter that is greater than diameters of the first portion 44G and the second portion 44H to enable the shoulder 44J to engage with the organizational mat 10.

Figure 16:
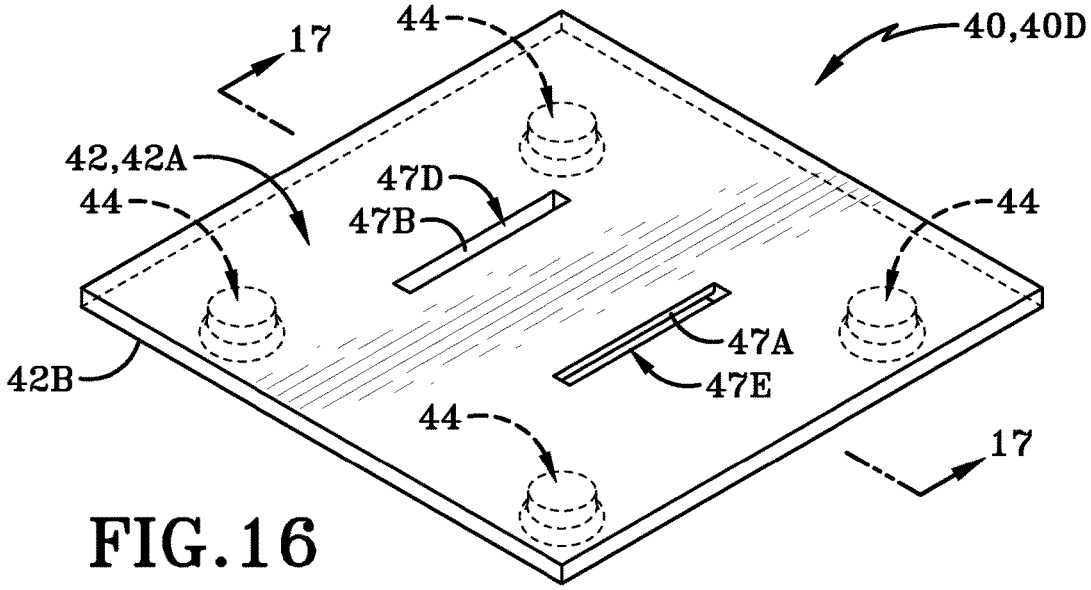
FIG. 16 is a front, top, first side isometric perspective view of a fourth storage apparatus of the organizational assembly.
Figure 17:
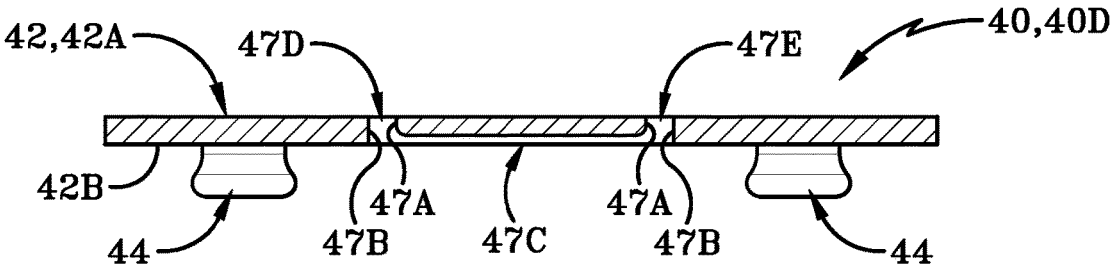
FIG. 17 is a cross-sectional view of the fourth storage apparatus taken in the direction of line 17-17 shown in FIG. 16.
Figure 18:
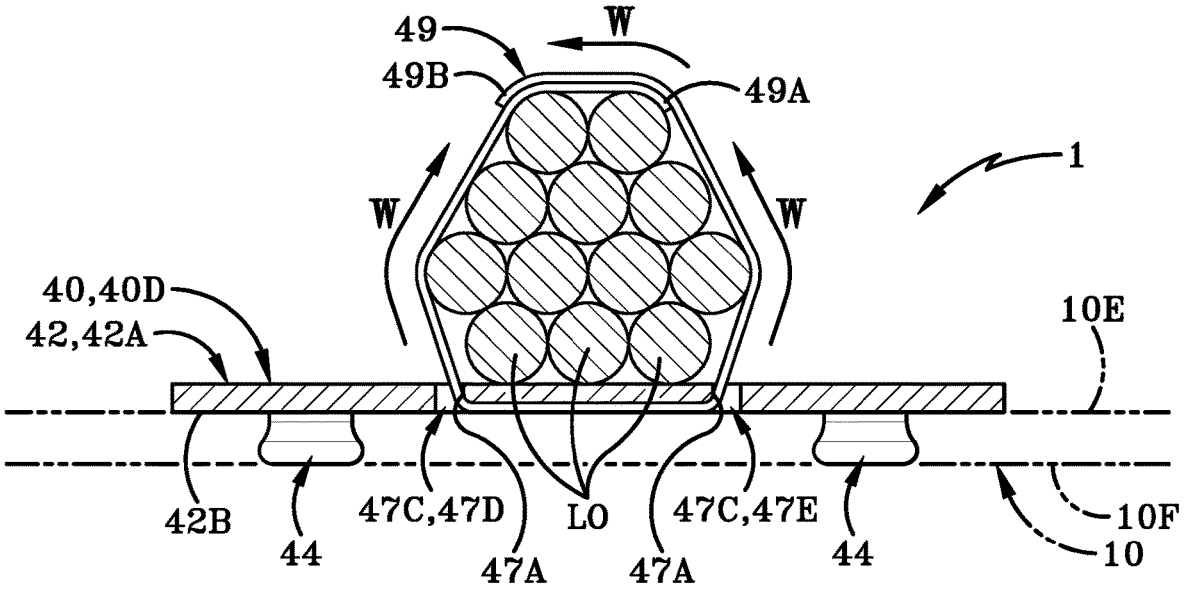
FIG. 18 is an operational view of the fourth storage apparatus securing a set of loose objects with a securement device operably engaged with the fourth storage apparatus.

Organizational assembly 1 may also include a fourth storage apparatus generally labeled with reference numeral 40D (see FIGS. 16-18). Fourth storage apparatus 40D of organizational assembly 1 is similar to each storage device of the set of first storage apparatuses 40A described above and illustrated in FIGS. 7-7B, except as detailed below. It should be understood that while organizational assembly 1 only includes a single fourth storage apparatus 40D illustrated herein, one or more fourth storage apparatuses 40D may be included with organizational assembly 1.

Similar to each storage apparatus of the set of first storage apparatuses 40A, the fourth storage apparatus 40D includes a main body 42 that has a storage wall 42A, a support wall 42B that is vertically opposite to the storage wall 42A, and a longitudinal axis defined therebetween. In the present disclosure, the storage wall 42A is configured to store one or more objects by at least one securement member or element, which is discussed in greater detail below. In the present disclosure, the support wall 42B is also configured to interface with the first engagement surface 10E or the second engagement surface 10F when the storage apparatus 40A interlockingly engages with the organizational mat 10.

However, in this illustrated embodiment, fourth storage apparatus 40D includes a first interior wall 42C that extends downwardly from the storage surface 42A toward the support surface 42B. The fourth storage apparatus 40D also includes a second interior wall 42D that extends downwardly from the storage surface 42 to the support surface 42B. In the present disclosure, the first interior wall 42C is positioned vertically above and is spaced apart from the second interior wall 42D. With such structural configuration, the first interior wall 42C and the second interior wall 42D collectively define a passageway 42E that is accessible at a first opening 42F and a second opening 42G defined at the storage surface 42A.

Such inclusion of the first interior wall 42C and the second interior wall 42D to collectively define the passageway 42E enables a securement member or device 43 to be fed through the main body 42 to bundle or secure loose objects "LO" together (see FIG. 18). In operation, a first end 43A of the securement device 43 or a second end 43B of the securement device 43 may be fed through the passageway 42E at either the first opening 42F and the second opening 42G to operably engage the securement device 43 with the main body 42, particularly with one or both of the first interior wall 42C and the second interior wall 42D. Once engaged, the first and second ends 43A, 43B of the securement device 43 may be wrapped or wound around the loose objects "LO" to enabler the securement device 43 to secure and hold such loose objects "LO" with main body 42 of fourth storage apparatus 40D; such wrapping or winding action of the securement device 42 to secure and hold such loose objects "LO" with main body 42 of fourth storage apparatus 40D is denoted by arrows labeled "W" in FIG. 18.

In the present disclosure, the first and second end 43A, 43B of securement device 43 secure at different locations on the securement device to secure and hold such loose objects "LO" with main body 42 of fourth storage apparatus 40D by attachment means (e.g., hook-and-loop attachment). In other exemplary embodiment, securement device 43 may be equipped with other components, elements, or means of securing loose objects "LO" together on storage surface 42A.

In the present disclosure, the securement device 43 is a separate component from the main body 42 such that the securement device 43 may be removed from main body 42. Stated differently, the securement device 43 is separable from the main body 42 such that the securement device 43 may be removed from main body 42 if desired by user of fourth storage apparatus 40D. In one exemplary embodiment, a portion of the securement device 43 located between the first end 43A and the second 43B may be secured with the first interior wall 42C and the second interior wall 42D inside of passageway 42E such that the securement device 43 is integral with the main body 42.

Figure 19:
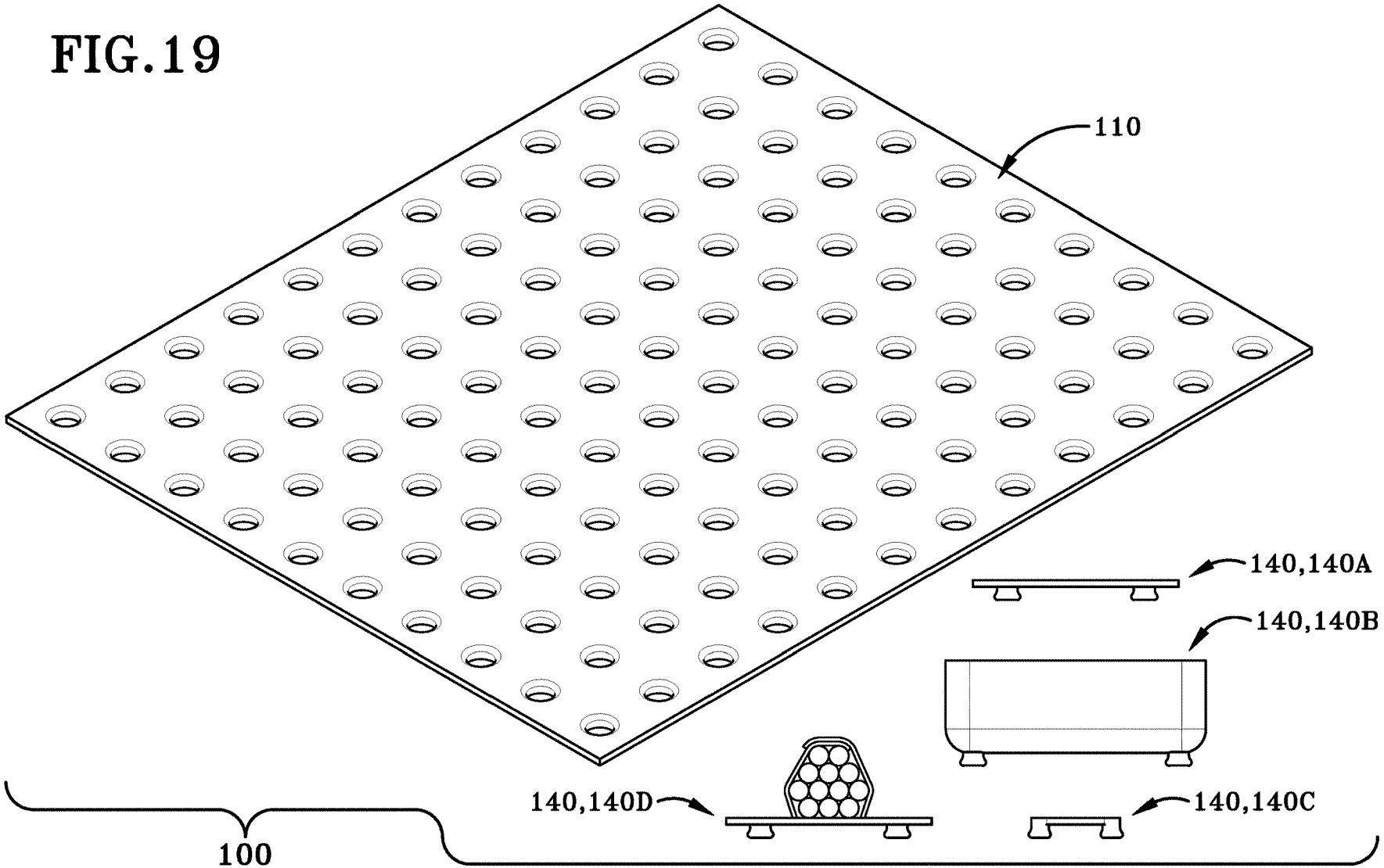
FIG. 19 is an exemplary organizational kit that includes an organizational mat, one or more first storage apparatuses, one or more second storage apparatuses, one or more third storage apparatuses, and one or more fourth storage apparatuses.

FIG. 19 illustrates an organizational kit 100. In the present disclosure, organizational kit 100 may include an organizational mat 110 (e.g., organizational mat 10), one or more first storage apparatuses 140A (e.g., first storage apparatus 40A), one or more second storage apparatuses 140B (e.g., second storage apparatus 40B), one or more third storage apparatuses 140C (e.g., third storage apparatus 40C), and one or more fourth storage apparatuses 140D (e.g., four storage apparatus 40D). It should be understood that organizational mat 110 may omit or remove one or more of the organizational mat 110, the one or more first storage apparatuses 140A, the one or more third storage apparatuses 140C, or the one or more fourth storage apparatuses 140D if desired.

Figure 20:
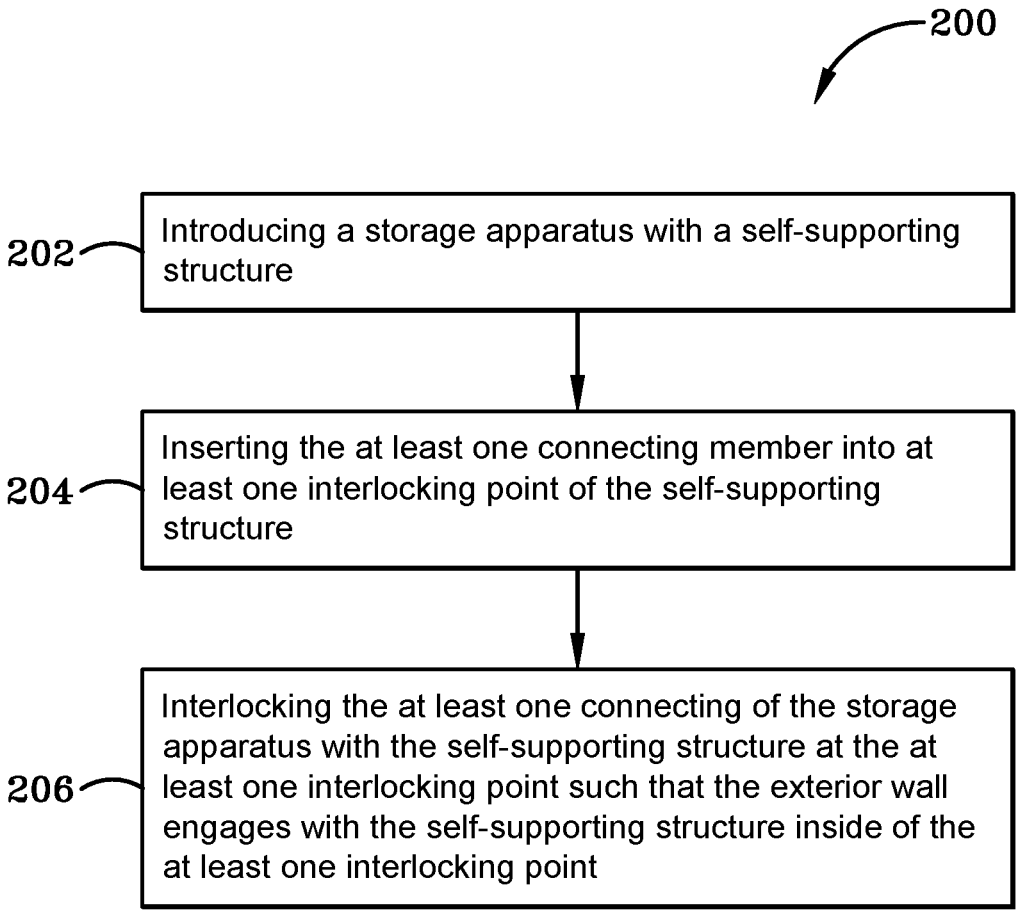
FIG. 20 is an exemplary method flowchart.

FIG. 20 is a method 200. An initial step 202 of method 200 includes introducing a storage apparatus with a self-supporting structure, the storage apparatus comprises: a main body configured to store at least one object; and at least one connecting member extending outwardly from the main body, the at least one connecting member comprising: a first end operably engaged with the main body; a second end longitudinally opposite to the first end and spaced apart from the main body; and a shoulder positioned between the first end and the second end. Another step 204 of method 200 includes inserting the at least one connecting member into at least one interlocking point of the self-supporting structure. Another step 206 of method 200 includes interlocking the at least one connecting of the storage apparatus with the self-supporting structure at the at least one interlocking point such that the self-supporting structure flexes around and conforms to the shoulder of at least one shoulder of each storage apparatus.

Optional and/or additional steps may be further included in method 200. In one exemplary embodiment, method 200 may further include that the step of interlocking the at least one connecting of the storage apparatus with the self-supporting structure at the at least one interlocking further includes that the first end of the at least one connecting member and the second end of the at least one connecting member are free from engaging with the self-supporting structure. In another exemplary embodiment, method 200 may further include steps of adhering at least one object with a storage wall of the main body; and contacting the self-supporting structure with a support wall of the main body, wherein the storage wall and the support wall face in opposing directions. In another exemplary embodiment, method 200 may further include steps of housing at least one object inside of a cavity defined by a first end of the main body, an interior wall of the main body, and a base wall of the main body; and contacting the self-supporting structure with a second end of the main body, wherein the cavity and the second end face in opposing directions. In another exemplary embodiment, method 200 may further include that the step of interlocking the at least one connecting of the storage apparatus with the self-supporting structure at the at least one interlocking point further includes that the exterior wall is frictionally fit with the self-supporting structure inside of the at least one interlocking point.

Figure 21:
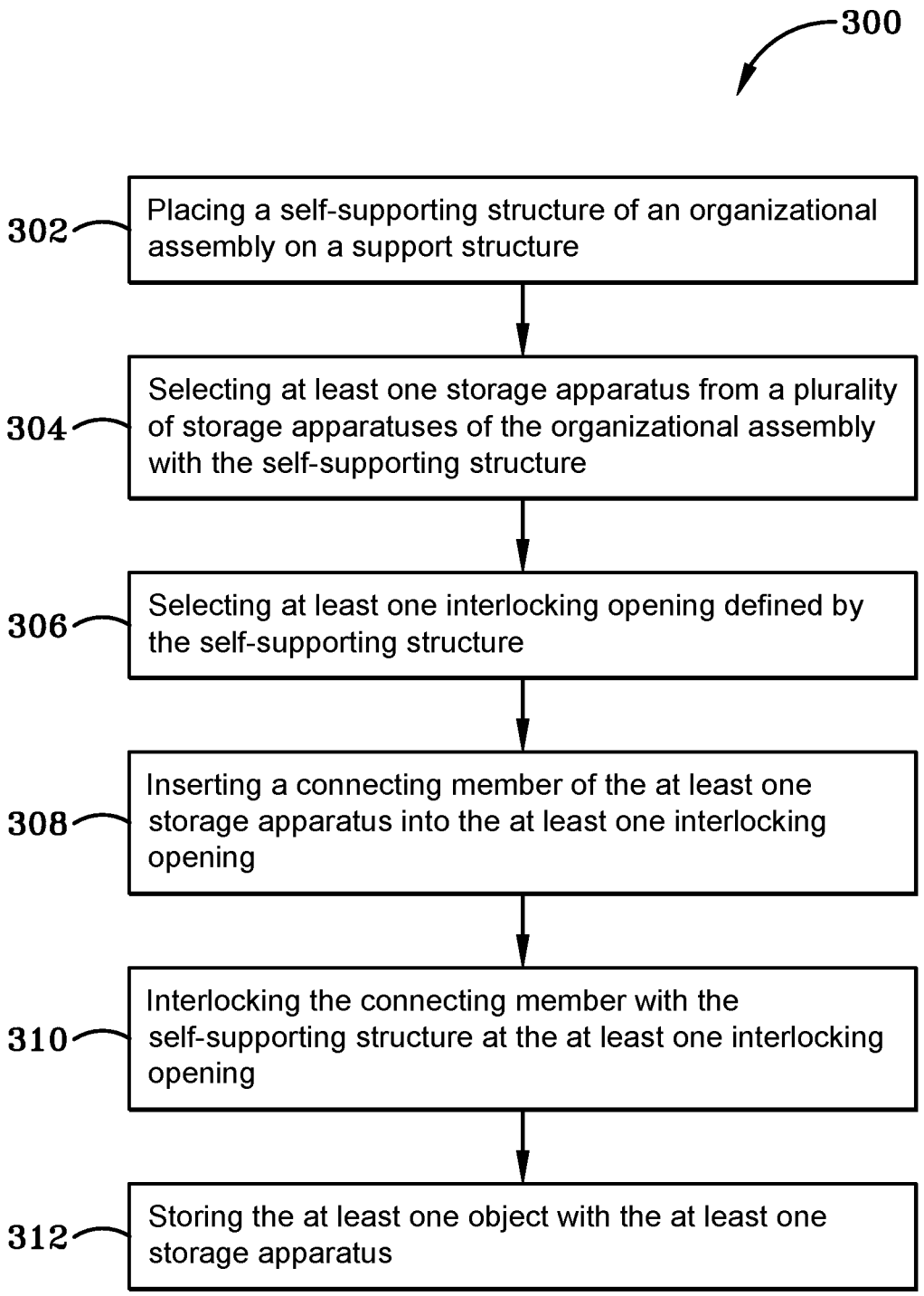
FIG. 21 is another exemplary method flowchart.

FIG. 21 is a method 300 of storing at least one object with at least one storage apparatus. An initial step 302 of method 300 includes placing a self-supporting structure of an organizational kit on a support structure, wherein the self-supporting structure defines a first length measured between a first end and a second end longitudinally opposite to the first end, and wherein the self-supporting structure defines a first width measured between a first side and a second side transversely opposite to the first side. Another step 304 of method 300 includes selecting at least one storage apparatus from a plurality of storage apparatuses of the organizational kit with the self-supporting structure. Another step 306 of method 300 includes selecting at least one interlocking opening defined by the self-supporting structure. Another step 308 of method 300 includes inserting a connecting member of the at least one storage apparatus into the at least one interlocking opening; Another step 310 of method 300 includes interlocking the connecting member with the self-supporting structure at the at least one interlocking opening. Another step 312 of method 300 includes storing the at least one object with the at least one storage apparatus.

Optional and/or additional steps may be further included in method 300. In one exemplary embodiment, method 300 may further include steps of cutting the self-supporting structure along a cutting groove of a set of first cutting grooves or a set of second cutting grooves defined in the self-supporting structure, wherein the set of first cutting grooves extends between the first end and the second end and the set of second cutting grooves extends between the first side and the second side; and providing the self-supporting structure at a second length that is less than the first length or a second width that is less than the first width. In another exemplary embodiment, method 300 may further include that the step of storing the at least one object with the at least one storage apparatus further comprises: adhering the at least one object with a storage wall of a main body of the at least one storage apparatus; and contacting the self-supporting structure with a support wall of the main body, wherein the storage wall and the support wall face in opposing directions. In another exemplary embodiment, method 300 may further include that the step of storing the at least one object with the at least one storage apparatus further comprises: housing at least one object inside of a cavity defined by a first end of a main body, an inner wall of the main body, and a base wall of the main body; and contacting the self-supporting structure with a second wall of the main body, wherein the cavity and the second wall face in opposing directions. In another exemplary embodiment, method 300 may further include a step of assembling a storage apparatus between one of a first engagement surface of the self-supporting structure and a second engagement surface of the self-supporting structure. In another exemplary embodiment, method 300 may further include steps of disengaging the connecting member of the at least one storage apparatus from the at least one interlocking opening; selecting at least another interlocking opening defined by the self-supporting structure; inserting the connecting member of the at least one storage apparatus into the at least another interlocking opening; and interlocking the connecting member with the self-supporting structure at the at least another interlocking opening.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of"

or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. An organizational kit, comprising:

a self-supporting structure defining a plurality of interlocking openings and being made of a first material, the self-supporting structure comprises:

a first end;

a second end opposite to the first end;

a first side positioned between the first end and the second end;

a second side positioned between the first end and the second end and opposite to the first side;

a main layer extending between the first end and the second end; and a sub layer extending between the first end and the second end and extending outwardly from the main layer, the sub layer having:

a set of first cutting grooves defined in the sub layer that extends between the first end of the self-supporting structure and the second end of the self-supporting structure;

a set of second cutting grooves defined in the sub layer that extends between the first side and the second side; and a plurality of cutting tiles divided between the set of first cutting grooves and the set of second cutting grooves; and a plurality of storage apparatuses selectively interlockably engageable with the self-supporting structure at the plurality of interlocking openings and being made of a second material different than the first material; each storage apparatus comprises:

a main body configured to store at least one object; and at least one connecting member extending outwardly from the main body, the at least one connecting member comprising:

a first end operably engaged with the main body;

a second end longitudinally opposite to the first end and spaced apart from the main body; and a shoulder positioned at the second end of the at least one connecting member;

wherein the shoulder of the at least one connecting member is configured to interlockably engage with the self-supporting structure inside of an interlocking opening of the plurality of interlocking openings such that the self-supporting structure flexes around and conforms to the shoulder of each storage apparatus wherein the plurality of storage apparatuses selectively interlockably engage at the main layer or at the sub layer;

wherein the set of first cutting grooves and the set of second cutting grooves are defined perpendicular to one another; and wherein the plurality of cutting tiles is configured to provide predetermined cutting indices.

2. The organizational kit of claim 1, wherein the self-supporting structure is made of a flexible, resilient material; and wherein each storage apparatus of the plurality of storage apparatuses is made of a rigid material.

3. The organizational kit of claim 1, wherein the self-supporting structure comprises:

a first end;

a second end opposite to the first end;

a first engagement surface extending between the first end and the second end; and a second engagement surface extending between the first end and the second end and facing in an opposite direction relative to the first engagement surface;

wherein the plurality of storage apparatuses selectively interlockably engages at the first engagement surface or the second engagement surface.

4. The organizational kit of claim 1, wherein each cutting tile of the plurality of cutting tiles comprises:

a length defined between at least one cutting groove of the set of first cutting grooves and at least another cutting groove of the set of first cutting grooves; and a width defined between at least one cutting groove of the set of second cutting grooves and at least another cutting groove of the set of second cutting grooves;

wherein the length and the width of each cutting tile of the plurality of cutting tiles is equal to one another.

5. The organizational kit of claim 3, wherein the self-supporting structure further comprises:

a plurality of inner walls extending between the first engagement surface and the second engagement surface and defining the plurality of interlocking openings;

wherein each inner wall of the plurality of inner walls is configured to frictionally fit with the at least one connecting member of each storage apparatus of the plurality of storage apparatuses.

6. The organizational kit of claim 5, wherein each interlocking opening of the plurality of interlocking openings further comprises:

a first diameter defined by each inner wall of the plurality of inner walls at each of the first engagement surface and the second engagement surface; and a second diameter defined by each inner wall of the plurality of inner walls at a location between the first engagement surface and the second engagement surface;

wherein the first diameter is greater than the second diameter.

7. The organizational kit of claim 6, wherein each interlocking opening of the plurality of interlocking openings further comprises:

a third diameter defined by each inner wall of the plurality of inner walls at a location between the first engagement surface and the second engagement surface;

wherein when the at least one connecting member of a storage apparatus of the plurality of storage apparatuses is free from engaging with the self-supporting structure, an inner wall of the plurality of inner walls defines the second diameter; and wherein when the at least one connecting member of the storage apparatus of the plurality of storage apparatuses interlockingly engages with the self-supporting structure, the inner wall of the plurality of inner walls transitions to the third diameter that is greater than the second diameter.

8. The organizational kit of claim 3, wherein each storage apparatus of the plurality of storage apparatuses comprises:

a storage wall configured to store the at least one object;

a support wall operably engaged with the at least one connecting member and configured to contact the self-supporting structure; and a set of curvilinear sides positioned between the storage wall and the support wall and extending between two corners of a set of corners of the main body.

9. The organizational kit of claim 8, wherein the at least one connecting member comprises:

a first exterior wall extending between the first end and the second end and defining a substantially concave shape;

wherein the first exterior wall frictionally fits with the self-supporting structure.

10. The organizational kit of claim 9, wherein the at least one connecting member further comprises:

a second exterior wall extending between the first end and the second end and defining a substantially planar shape;

wherein the second exterior wall faces away from the first exterior wall.

11. The organizational kit of claim 8, further comprising:

at least one adhesive member operably engaging the at least one object with a portion of the storage wall of the main body to hold at least one object with the storage wall.

12. The organization kit of claim 8, wherein the at least one connecting member further comprises:

a first portion extending from the first end towards the second end;

a second portion extending from the first portion to the shoulder;

a first outer profile shape defined along the length of the second portion; and a second outer profile shape defined along the length of the shoulder;

wherein the first outer profile shape and the second outer profile shape are different from one another.

13. The organizational kit of claim 8, wherein the main body comprises:

a passageway defined by a first interior wall and a second interior wall of the main body spaced apart from one another and positioned between the storage wall and the support wall; and a securement device that is partially housed inside of the passageway to hold a plurality of loose objects on the storage wall.

14. The organizational kit of claim 3, wherein the main body comprises:

a first end;

a second end operably engaged with the at least one connecting member and opposite to the first end; and at least one cavity defined in the main body between the first end and the second end;

wherein the main body is configured to store the at least one object inside of the at least one cavity.

15. A method of storing at least one object with at least one storage apparatus, comprising:

placing a self-supporting structure of an organizational kit on a support structure, wherein the self-supporting structure defines a first length measured between a first end and a second end longitudinally opposite to the first end, and wherein the self-supporting structure defines a first width measured between a first side and a second side transversely opposite to the first side; the self-supporting structure comprising:

a main layer extending between the first end and the second end; and a sub layer extending between the first end and the second end and extending outwardly from the main layer, the sub layer having:

a set of first cutting grooves defined in the sub layer that extends between the first end of the self-supporting structure and the second end of the self-supporting structure;

a set of second cutting grooves defined in the sub layer that extends between the first side and the second side; and a plurality of cutting tiles divided between the set of first cutting grooves and the set of second cutting grooves;

selecting at least one storage apparatus from a plurality of storage apparatuses of the organizational kit with the self-supporting structure, the at least one storage apparatus comprising:

a main body configured to store at least one object; and at least one connecting member extending outwardly from the main body, the at least one connecting member comprising:

a first end operably engaged with the main body;

a second end longitudinally opposite to the first end and spaced apart from the main body; and a shoulder positioned at the second end of the at least one connecting member;

selecting at least one interlocking opening defined by the self-supporting structure;

inserting a connecting member of the at least one storage apparatus into the at least one interlocking opening;

interlocking the connecting member with the self-supporting structure at the at least one interlocking opening such that the self-supporting structure flexes around and conforms to the shoulder of each storage apparatus; and storing the at least one object with the at least one storage apparatus wherein the plurality of storage apparatuses selectively interlockably engage at the main layer or at the sub layer;

wherein the set of first cutting grooves and the set of second cutting grooves are defined perpendicular to one another; and wherein the plurality of cutting tiles is configured to provide predetermined cutting indices.

16. The method of claim 15, further comprising:

cutting the self-supporting structure along a cutting groove of the set of first cutting grooves or the set of second cutting grooves defined in the self-supporting structure; and providing the self-supporting structure at a second length that is less than the first length or a second width that is less than the first width.

17. The method of claim 15, wherein the step of storing the at least one object with the at least one storage apparatus further comprises:

adhering the at least one object with a storage wall of a main body of the at least one storage apparatus; and contacting the self-supporting structure with a support wall of the main body, wherein the storage wall and the support wall face in opposing directions.

18. The method of claim 15, wherein the step of storing the at least one object with the at least one storage apparatus further comprises:

housing at least one object inside of a cavity defined by a first end of a main body, an inner wall of the main body, and a base wall of the main body; and contacting the self-supporting structure with a second wall of the main body, wherein the cavity and the second wall face in opposing directions.

19. The method of claim 15, further comprising:

assembling a storage apparatus between one of a first engagement surface of the self-supporting structure and a second engagement surface of the self-supporting structure.

20. The method of claim 15, further comprising:

disengaging the connecting member of the at least one storage apparatus from the at least one interlocking opening;

selecting at least another interlocking opening defined by the self-supporting structure;

inserting the connecting member of the at least one storage apparatus into the at least another interlocking opening; and interlocking the connecting member with the self-supporting structure at the at least another interlocking opening.

* * * * *